US010729965B2

(12) United States Patent
Powell

(10) Patent No.: US 10,729,965 B2
(45) Date of Patent: Aug. 4, 2020

(54) AUDIBLE BELT GUIDE IN A TREADMILL

(71) Applicant: ICON Health & Fitness, Inc., Logan, UT (US)

(72) Inventor: Wade A. Powell, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 158 days.

(21) Appl. No.: 15/853,415

(22) Filed: Dec. 22, 2017

(65) Prior Publication Data

US 2019/0192952 A1 Jun. 27, 2019

(51) Int. Cl.
*A63B 22/02* (2006.01)
*A63B 22/00* (2006.01)
(Continued)

(52) U.S. Cl.
CPC ..... *A63B 71/0619* (2013.01); *A63B 22/0023* (2013.01); *A63B 22/025* (2015.10); *A63B 22/0221* (2015.10); *A63B 22/0285* (2013.01); *A63B 24/0087* (2013.01); *A63B 71/0054* (2013.01); *A63B 71/0686* (2013.01);
(Continued)

(58) Field of Classification Search
CPC ..... A63B 71/0619; A63B 71/0054; A63B 22/0023; A63B 22/0285; A63B 71/0686; A63B 22/0221; A63B 24/0087; A63B 22/025; A63B 2071/0691; A63B 2220/808; A63B 22/0046; A63B 2071/068; A63B 2024/009; A63B 2230/75; A63B 2071/0683; A63B 2220/13; A63B 2230/06; A63B 2071/0625; A63B 2071/0627;
(Continued)

(56) References Cited

U.S. PATENT DOCUMENTS 232,022 A 9/1880 Gifford
284,294 A 9/1883 Graves
(Continued)

FOREIGN PATENT DOCUMENTS

CN 205699101 * 11/2016

OTHER PUBLICATIONS

Office Action for Taiwanese Application No. 107145797, dated Nov. 4, 2019, 21 pages
(Continued)

*Primary Examiner* — Loan B Jimenez
*Assistant Examiner* — Shila Jalalzadeh Abyaneh
(74) *Attorney, Agent, or Firm* — Ray Quinney & Nebeker

(57) ABSTRACT

A treadmill may include a platform, at least one pulley attached to the platform, a sliding surface of the platform, a tread belt riding portion of the sliding surface, a tread belt surrounding the pulley and the sliding surface, the tread belt having at least one side edge, and a belt guide incorporated into the platform. The belt guide includes a textured portion of the sliding surface aligned with the side edge of the tread belt and spaced apart therefrom when the tread belt is positioned entirely within the tread belt riding portion. When the textured portion comes into contact the tread belt from the tread belt being misaligned out of the tread belt riding portion, the tread belt and the textured portion collectively produce a misalignment sound audible to a user when the tread belt moves against the sliding surface.

20 Claims, 12 Drawing Sheets

(51) Int. Cl.

| | |
|---|---|
| ***A63B 71/06*** | (2006.01) |
| ***A63B 24/00*** | (2006.01) |
| ***A63B 71/00*** | (2006.01) |

(52) U.S. Cl.

CPC ..... *A63B 22/0046* (2013.01); *A63B 71/0622* (2013.01); *A63B 2024/009* (2013.01); *A63B 2071/0602* (2013.01); *A63B 2071/068* (2013.01); *A63B 2071/0625* (2013.01); *A63B 2071/0627* (2013.01); *A63B 2071/0633* (2013.01); *A63B 2071/0683* (2013.01); *A63B 2071/0691* (2013.01); *A63B 2209/00* (2013.01); *A63B 2220/13* (2013.01); *A63B 2220/808* (2013.01); *A63B 2225/30* (2013.01); *A63B 2230/06* (2013.01); *A63B 2230/75* (2013.01)

(58) Field of Classification Search

CPC ..... A63B 2225/30; A63B 2209/00; A63B 2071/0633; A63B 71/0622; A63B 2071/0602

See application file for complete search history.

(56) References Cited

U.S. PATENT DOCUMENTS

| | | | | |
|---|---|---|---|---|
| 321,388 | A | | 6/1885 | Ruebsam |
| 339,638 | A | | 4/1886 | Goldie |
| 421,779 | A | | 2/1890 | Steven |
| 447,780 | A | | 3/1891 | Luge |
| 450,792 | A | | 4/1891 | Dodd |
| 659,216 | A | | 10/1900 | Dowling |
| 663,486 | A | | 12/1900 | Boren |
| 674,391 | A | | 5/1901 | Baker |
| 683,284 | A | | 9/1901 | Honey |
| 766,930 | A | | 8/1904 | Clemons |
| 881,521 | A | | 3/1908 | Wilson |
| 897,722 | A | | 9/1908 | Day |
| 931,394 | A | | 8/1909 | Day |
| 937,795 | A | | 10/1909 | Hackney |
| 1,016,729 | A | | 2/1912 | Barrett |
| 1,020,777 | A | | 3/1912 | Peterson |
| 1,064,968 | A | | 6/1913 | Hagen |
| 1,082,940 | A | | 12/1913 | Flora |
| 1,211,765 | A | | 1/1917 | Schmidt |
| 1,570,482 | A | | 1/1926 | Hale |
| 1,580,530 | A | | 4/1926 | Rambo |
| 1,585,748 | A | | 5/1926 | Wendelken |
| 1,715,870 | A | | 6/1929 | Augustine |
| 1,766,089 | A | | 6/1930 | Wood |
| 1,778,635 | A | | 10/1930 | Heisler |
| 1,824,406 | A | | 9/1931 | Petersime |
| 1,850,530 | A | | 3/1932 | Brown |
| 1,893,728 | A | | 1/1933 | Bullis |
| 1,902,694 | A | | 3/1933 | Edwards |
| 1,919,627 | A | | 7/1933 | FitzGerald |
| 1,928,089 | A | | 9/1933 | Blickman |
| 1,973,945 | A | | 9/1934 | Chavin |
| 1,978,579 | A | | 10/1934 | Hooks |
| 1,982,843 | A | | 12/1934 | Traver |
| 2,067,136 | A | | 1/1937 | Bridenbaugh |
| 2,117,957 | A | | 5/1938 | Ritter |
| 2,165,700 | A | | 7/1939 | Henry |
| 2,177,957 | A | | 10/1939 | Stewart |
| 2,219,219 | A | | 10/1940 | Boger |
| 2,247,946 | A | | 7/1941 | Hein et al. |
| 2,255,864 | A | | 9/1941 | Stephens |
| 2,315,485 | A | | 4/1943 | Jones |
| 2,399,915 | A | | 5/1946 | Drake |
| 2,440,644 | A | | 4/1948 | Powell |
| 2,569,007 | A | | 9/1951 | Klyce |
| 2,607,816 | A | | 8/1952 | Ryder |
| 2,632,645 | A | | 3/1953 | Barkschat |
| 2,645,539 | A | | 7/1953 | Thompson |
| 2,646,282 | A | | 7/1953 | Ringman |
| 2,648,540 | A | | 8/1953 | Hunter |
| 2,674,453 | A | | 4/1954 | Hummert |
| 2,743,623 | A | | 5/1956 | Wells |
| 2,746,822 | A | | 5/1956 | Copenhaver |
| 2,842,365 | A | | 7/1958 | Kelley |
| 2,855,200 | A | | 10/1958 | Blickman |
| 2,874,971 | A | | 2/1959 | Devery |
| 2,969,060 | A | | 1/1961 | Swanda |
| 2,984,594 | A | | 5/1961 | Runton |
| 3,035,671 | A | | 5/1962 | Sicherman |
| 3,059,312 | A | | 10/1962 | Jamieson |
| 3,068,950 | A | | 12/1962 | Davidson |
| 3,072,426 | A | | 1/1963 | Gilbert |
| 3,112,108 | A | | 11/1963 | Hanke |
| 3,127,171 | A | | 3/1964 | Noland et al. |
| 3,179,071 | A | | 4/1965 | Johnston |
| 3,193,287 | A | | 7/1965 | Robinson |
| 3,205,888 | A | | 9/1965 | Stroop |
| 3,316,898 | A | | 5/1967 | Brown |
| 3,319,273 | A | | 5/1967 | Lawrence |
| 3,342,485 | A | | 9/1967 | Martin |
| 3,345,067 | A | | 10/1967 | Smith |
| 3,358,813 | A | | 12/1967 | Kohlhagen |
| 3,378,259 | A | | 4/1968 | Kupchinski |
| 3,408,067 | A | | 10/1968 | Armstrong |
| 3,408,069 | A | | 10/1968 | Lewis |
| 3,411,497 | A | | 11/1968 | Rickey et al. |
| 3,416,174 | A | | 12/1968 | Novitske |
| 3,430,084 | A | | 2/1969 | Hall |
| 3,430,507 | A | | 3/1969 | Hurst et al. |
| 3,438,627 | A | | 4/1969 | La Lanne |
| 3,444,830 | A | | 5/1969 | Doetsch |
| 3,446,503 | A | | 5/1969 | Lawton |
| 3,501,140 | A | | 3/1970 | Eichorn |
| 3,511,500 | A | | 5/1970 | Dunn |
| 3,514,110 | A | | 5/1970 | Thomander |
| 3,518,985 | A | | 7/1970 | Quinton |
| 3,522,947 | A | | 8/1970 | Anderson |
| 3,547,435 | A | | 12/1970 | Scott |
| 3,554,541 | A | * | 1/1971 | Seaman ..... A63B 22/02 482/54 |
| 3,563,541 | A | | 2/1971 | Sanquist |
| 3,566,861 | A | | 3/1971 | Weiss |
| 3,567,219 | A | | 3/1971 | Foster |
| 3,568,669 | A | | 3/1971 | Stites |
| 3,572,700 | A | | 3/1971 | Mastropaolo |
| 3,583,465 | A | | 6/1971 | Youngs et al. |
| 3,586,322 | A | | 6/1971 | Kverneland |
| 3,589,715 | A | | 6/1971 | Mark |
| 3,592,466 | A | | 7/1971 | Parsons |
| 3,598,404 | A | | 8/1971 | Bowman |
| 3,602,502 | A | | 8/1971 | Jaegar |
| 3,606,320 | A | | 9/1971 | Erwin, Jr. |
| 3,608,898 | A | | 9/1971 | Berlin |
| 3,614,097 | A | | 10/1971 | Blickman |
| 3,628,654 | A | | 12/1971 | Haracz |
| 3,628,791 | A | | 12/1971 | Garcia |
| 3,634,895 | A | | 1/1972 | Childers |
| 3,636,577 | A | | 1/1972 | Nissen |
| 3,638,941 | A | | 2/1972 | Kulkens |
| 3,640,528 | A | | 2/1972 | Proctor |
| 3,641,601 | A | | 2/1972 | Sieg |
| 3,642,279 | A | | 2/1972 | Cutter |
| 3,643,943 | A | | 2/1972 | Erwin, Jr. et al. |
| 3,650,529 | A | | 3/1972 | Salm |
| 3,658,327 | A | | 4/1972 | Thiede |
| 3,659,845 | A | | 5/1972 | Quinton |
| 3,664,666 | A | | 5/1972 | Lloyd |
| 3,686,776 | A | | 8/1972 | Dahl |
| 3,689,066 | A | | 9/1972 | Hagen |
| 3,703,284 | A | | 11/1972 | Hesen |
| 3,708,166 | A | | 1/1973 | Annas |
| 3,709,197 | A | | 1/1973 | Moseley |
| 3,731,917 | A | | 5/1973 | Townsend |
| 3,738,649 | A | | 6/1973 | Miller |
| 3,741,538 | A | | 6/1973 | Useldinger |
| 3,751,033 | A | | 8/1973 | Rosenthal |
| 3,756,595 | A | | 9/1973 | Hague |

(56) References Cited

U.S. PATENT DOCUMENTS 3,767,195 A 10/1973 Dimick
3,788,412 A 1/1974 Vincent
3,792,860 A 2/1974 Seines
3,809,393 A 5/1974 Jones
3,814,420 A 6/1974 Encke
3,822,488 A 7/1974 Johnson
3,826,491 A 7/1974 Elder
3,848,467 A 11/1974 Flavell
3,851,874 A 12/1974 Wilkin
3,858,938 A 1/1975 Kristensson et al.
3,861,215 A 1/1975 Bradley
3,869,121 A 3/1975 Flavell
3,870,297 A 3/1975 Elder
3,873,789 A * 3/1975 Ward ..... H01H 13/186 200/61.41
3,874,657 A 4/1975 Niebojewski
3,880,274 A 4/1975 Bechtloff
3,883,922 A 5/1975 Fleischhauer
3,892,404 A 7/1975 Martucci
3,901,379 A 8/1975 Bruhm
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,072,309 A 2/1978 Wilson
4,074,903 A 2/1978 Diez de Aux
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,113,071 A 9/1978 Muller et al.
4,120,294 A 10/1978 Wolfe
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,227,689 A 10/1980 Keiser
4,235,437 A 11/1980 Ruis et al.
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,300,761 A 11/1981 Howard
4,313,602 A 2/1982 Sullivan
4,313,603 A 2/1982 Simjian
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,342,452 A 8/1982 Summa
4,344,616 A 8/1982 Ogden
4,349,597 A 9/1982 Fine et al.
4,350,336 A 9/1982 Hanford
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Aurensan
4,383,684 A 5/1983 Schliep
4,383,714 A 5/1983 Ishida
4,397,462 A 8/1983 Wilmarth
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,489,933 A 12/1984 Fisher
4,491,318 A 1/1985 Francke
4,494,662 A 1/1985 Clymer
4,496,147 A 1/1985 DeCloux et al.
4,499,784 A 2/1985 Shum
4,502,679 A 3/1985 De Lorenzo
4,505,474 A 3/1985 Mattox
4,505,475 A 3/1985 Olschansky et al.
4,509,510 A 4/1985 Hook
4,512,567 A 4/1985 Phillips
4,512,571 A 4/1985 Hermelin
4,522,394 A 6/1985 Broussard
4,529,194 A 7/1985 Haaheim
4,533,136 A 8/1985 Smith et al.
4,536,244 A 8/1985 Greci et al.
4,538,805 A 9/1985 Parviainen
4,542,899 A 9/1985 Hendricks
4,544,152 A 10/1985 Taitel
4,544,153 A 10/1985 Babcock
4,546,971 A 10/1985 Raasoch
4,548,405 A 10/1985 Lee
4,549,733 A 10/1985 Salyer
4,556,216 A 12/1985 Pitkanen
4,563,001 A 1/1986 Terauds
4,563,003 A 1/1986 Bugallo et al.
4,564,193 A 1/1986 Stewart
4,566,689 A 1/1986 Ogden
4,566,732 A 1/1986 Ostergaard, Sr.
4,569,518 A 2/1986 Fulks
4,571,682 A 2/1986 Silverman et al.
4,572,500 A 2/1986 Weiss

(56) References Cited

U.S. PATENT DOCUMENTS 4,572,504 A 2/1986 DiBartolo
4,576,352 A 3/1986 Ogden
4,576,376 A 3/1986 Miller
4,577,860 A 3/1986 Matias et al.
4,580,983 A 4/1986 Cassini et al.
4,581,269 A 4/1986 Tilman
4,582,320 A 4/1986 Shaw
4,589,656 A 5/1986 Baldwin
4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim
4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Del Mar Avionics
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.

(56) References Cited

U.S. PATENT DOCUMENTS 4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix
4,949,958 A 8/1990 Richey
4,949,959 A 8/1990 Stevens
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,959,040 A * 9/1990 Gardner ..... B65G 39/16
198/807
4,960,276 A 10/1990 Feuer et al.
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,984,810 A 1/1991 Stearns et al.
4,986,261 A 1/1991 Iams et al.
4,989,860 A 2/1991 Iams et al.
4,998,725 A 3/1991 Watterson et al.
5,000,440 A 3/1991 Lynch
5,000,442 A 3/1991 Dalebout et al.
5,001,632 A 3/1991 Hall Tipping
5,002,271 A 3/1991 Gonzales
5,004,224 A 4/1991 Wang
5,007,630 A 4/1991 Real et al.
5,007,631 A 4/1991 Wang
5,013,031 A 5/1991 Bull
5,016,870 A 5/1991 Bulloch et al.
5,020,793 A 6/1991 Loane
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
RE33,662 E 8/1991 Blair et al.
5,037,084 A 8/1991 Flor
5,037,089 A 8/1991 Spagnuolo
5,039,089 A 8/1991 Lapcevic
5,039,091 A 8/1991 Johnson
5,042,799 A 8/1991 Stanley
5,046,382 A 9/1991 Steinberg
5,046,722 A 9/1991 Antoon
5,048,823 A 9/1991 Bean
5,051,638 A 9/1991 Pyles
5,054,770 A 10/1991 Bull
5,058,881 A 10/1991 Measom
5,058,882 A 10/1991 Dalebout et al.
5,058,888 A 10/1991 Walker et al.
5,062,626 A 11/1991 Dalebout et al.
5,062,629 A 11/1991 Vaughan
5,062,632 A 11/1991 Dalebout et al.
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,087,047 A 2/1992 McConnell
5,088,729 A 2/1992 Dalebout
5,094,249 A 3/1992 Marras et al.
5,094,447 A 3/1992 Wang
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson et al.
5,108,093 A 4/1992 Watterson
5,109,778 A 5/1992 Berkowitz et al.
5,110,117 A 5/1992 Fisher et al.
5,112,045 A 5/1992 Mason et al.
5,114,388 A 5/1992 Trulaske
5,114,391 A 5/1992 Pitzen et al.
5,123,629 A 6/1992 Takeuchi
5,123,885 A 6/1992 Shields
5,123,886 A 6/1992 Cook
5,129,872 A 7/1992 Dalton et al.
5,131,895 A 7/1992 Rogers, Jr.
5,135,458 A 8/1992 Huang
5,137,501 A 8/1992 Mertesdorf
5,138,730 A 8/1992 Masuda
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,154,684 A 10/1992 Delf
5,158,520 A 10/1992 Lemke et al.
5,162,029 A 11/1992 Gerard
5,163,885 A 11/1992 Wanzer et al.
5,167,159 A 12/1992 Lucking
5,167,597 A 12/1992 David
5,171,196 A 12/1992 Lynch
5,178,593 A 1/1993 Roberts
5,178,599 A 1/1993 Scott
5,181,894 A 1/1993 Shieng
5,184,295 A 2/1993 Mann
5,184,988 A 2/1993 Dunham
5,186,697 A 2/1993 Rennex
5,192,255 A 3/1993 Dalebout et al.
5,192,257 A 3/1993 Panasewicz
5,192,258 A 3/1993 Keller
5,195,781 A 3/1993 Osawa
5,195,935 A 3/1993 Fencel
5,195,937 A 3/1993 Engel et al.

(56) References Cited

U.S. PATENT DOCUMENTS 5,199,931 A 4/1993 Easley et al.
5,201,694 A 4/1993 Zappel
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,207,489 A 5/1993 Miller
5,207,622 A 5/1993 Wilkinson et al.
5,207,625 A 5/1993 White
5,207,628 A 5/1993 Graham
5,211,617 A 5/1993 Millen
5,215,510 A 6/1993 Baran
5,217,422 A 6/1993 Domzalski
5,226,866 A 7/1993 Engel et al.
5,232,422 A 8/1993 Bishop, Jr.
5,234,392 A 8/1993 Clark
5,240,417 A 8/1993 Smithson et al.
5,242,339 A 9/1993 Thornton
5,242,340 A 9/1993 Jerome
5,242,343 A 9/1993 Miller
5,242,347 A 9/1993 Keeton
5,247,853 A 9/1993 Dalebout
5,250,012 A 10/1993 Meredith
5,250,013 A 10/1993 Brangi
5,254,067 A 10/1993 Habing et al.
5,256,117 A 10/1993 Potts et al.
5,256,118 A 10/1993 Chen
5,256,126 A 10/1993 Grotstein
5,257,701 A 11/1993 Edelson
5,257,964 A 11/1993 Petters
5,261,864 A 11/1993 Fitzpatrick
5,269,736 A 12/1993 Roberts
5,271,416 A 12/1993 Lepley
5,273,285 A 12/1993 Long
5,277,678 A 1/1994 Friedebach et al.
5,279,528 A 1/1994 Dalebout et al.
5,279,529 A 1/1994 Eschenbach
5,279,531 A 1/1994 Jen-Huey
5,282,776 A 2/1994 Dalebout
5,284,461 A 2/1994 Wilkinson et al.
5,290,205 A 3/1994 Densmore et al.
5,290,211 A 3/1994 Stearns
5,292,293 A 3/1994 Schumacher
5,295,927 A 3/1994 Easley
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,318,487 A 6/1994 Golen et al.
5,320,343 A 6/1994 McKinney
5,320,588 A 6/1994 Wanzer et al.
5,320,589 A * 6/1994 Singleton ..... A63B 22/02 482/54
5,320,591 A 6/1994 Harmon et al.
5,320,641 A 6/1994 Riddle
5,324,242 A 6/1994 Lo
5,328,420 A 7/1994 Allen
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
RE34,728 E 9/1994 Hall-Tipping
5,344,372 A 9/1994 Hung
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,248 A 10/1994 Rawls et al.
5,354,251 A 10/1994 Sleamaker
5,356,356 A 10/1994 Hildebrandt et al.
5,358,461 A 10/1994 Bailey, Jr.
5,359,986 A 11/1994 Magrath, III et al.
5,362,069 A 11/1994 Hall-Tipping
5,362,295 A 11/1994 Nurge
5,364,327 A 11/1994 Graham
5,368,532 A 11/1994 Farnet
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,378,212 A 1/1995 Pin-Kuo
5,380,258 A 1/1995 Hawley, Jr.
5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,387,169 A 2/1995 Wang
5,387,170 A 2/1995 Rawls et al.
5,387,171 A 2/1995 Casey et al.
5,394,922 A 3/1995 Colson et al.
5,396,876 A 3/1995 Liscio et al.
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,406,661 A 4/1995 Pekar
5,407,403 A 4/1995 Coleman
5,407,408 A 4/1995 Wilkinson
5,409,435 A 4/1995 Daniels
RE34,959 E 5/1995 Potts
5,410,971 A 5/1995 Golden et al.
5,417,643 A 5/1995 Taylor
5,419,570 A 5/1995 Bollotte
5,419,571 A 5/1995 Vaughan
5,419,751 A 5/1995 Byrd et al.
5,423,729 A 6/1995 Eschenbach
5,423,730 A 6/1995 Hirsch
5,429,563 A 7/1995 Engel et al.
5,429,569 A 7/1995 Gunnari
5,431,612 A 7/1995 Holden
5,433,679 A 7/1995 Szymczak et al.
5,435,315 A 7/1995 McPhee et al.
5,435,798 A 7/1995 Habing et al.
5,441,467 A 8/1995 Stevens
5,441,468 A 8/1995 Deckers et al.
5,449,334 A 9/1995 Kingsbury
5,454,772 A 10/1995 Rodden
5,454,773 A 10/1995 Blanchard et al.
5,456,648 A 10/1995 Edinburg
5,460,379 A 10/1995 Cleland
5,460,586 A 10/1995 Wilkinson
5,462,503 A 10/1995 Benjamin et al.
5,462,504 A 10/1995 Trulaske et al.
5,466,200 A 11/1995 Ulrich et al.
5,466,203 A 11/1995 Chen
5,470,298 A 11/1995 Curtis
5,471,405 A 11/1995 Marsh
5,474,087 A 12/1995 Nashner

(56) References Cited

U.S. PATENT DOCUMENTS 5,474,510 A 12/1995 Chen
5,476,430 A 12/1995 Lee et al.
5,484,358 A 1/1996 Wang et al.
5,484,362 A 1/1996 Skowronski et al.
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,520 A 2/1996 Brown
5,496,235 A 3/1996 Stevens
5,496,236 A 3/1996 Buonauito
5,496,238 A 3/1996 Taylor
5,496,239 A 3/1996 Kallman
5,499,956 A 3/1996 Habing et al.
5,505,011 A 4/1996 Bleimhofer
5,507,271 A 4/1996 Actor
5,509,870 A 4/1996 Lloyd
5,512,025 A 4/1996 Dalebout et al.
5,512,029 A 4/1996 Barnard
5,514,053 A 5/1996 Hawkins et al.
5,518,471 A 5/1996 Hettinger et al.
5,518,473 A 5/1996 Miller
5,520,599 A 5/1996 Chen
5,522,783 A 6/1996 Gordon
5,527,245 A 6/1996 Dalebout et al.
5,529,553 A * 6/1996 Finlayson ..... A63B 22/02 482/51
5,529,554 A 6/1996 Eschenbach
5,531,658 A 7/1996 L. S. C.
5,533,899 A 7/1996 Young
5,533,948 A 7/1996 Wilkinson
5,533,951 A 7/1996 Chang
5,538,489 A 7/1996 Magid
5,542,892 A 8/1996 Buhler
5,545,112 A 8/1996 Densmore et al.
5,549,052 A 8/1996 Hoffman
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,128 A 10/1996 Dalebout
5,569,138 A 10/1996 Wang et al.
5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski

(56) References Cited

U.S. PATENT DOCUMENTS

| | | | |
|---|---|---|---|
| 5,752,879 | A | 5/1998 | Berdut |
| 5,752,897 | A | 5/1998 | Skowronski et al. |
| 5,755,642 | A | 5/1998 | Miller |
| 5,755,645 | A | 5/1998 | Miller et al. |
| 5,755,651 | A | 5/1998 | Homyonfer |
| 5,759,136 | A | 6/1998 | Chen |
| 5,760,353 | A | 6/1998 | Rapp |
| 5,761,831 | A | 6/1998 | Cho |
| 5,762,587 | A | 6/1998 | Dalebout et al. |
| 5,762,588 | A | 6/1998 | Chen |
| 5,769,759 | A | 6/1998 | Alter |
| 5,771,152 | A | 6/1998 | Crompton et al. |
| 5,772,522 | A | 6/1998 | Nesbit |
| 5,772,558 | A | 6/1998 | Rodgers, Jr. |
| 5,772,560 | A | 6/1998 | Watterson et al. |
| 5,776,582 | A | 7/1998 | Needham |
| 5,779,599 | A | 7/1998 | Chen |
| 5,779,607 | A | 7/1998 | Harris |
| 5,782,639 | A | 7/1998 | Beal |
| 5,782,723 | A | 7/1998 | Kuo |
| 5,785,630 | A | 7/1998 | Bobick et al. |
| 5,788,609 | A | 8/1998 | Miller |
| 5,788,610 | A | 8/1998 | Eschenbach |
| 5,788,611 | A | 8/1998 | Kuo |
| 5,792,027 | A | 8/1998 | Gvoich |
| 5,792,031 | A | 8/1998 | Alton |
| 5,795,270 | A | 8/1998 | Woods et al. |
| 5,797,578 | A | 8/1998 | Graffeo |
| 5,803,874 | A | 9/1998 | Wilkinson |
| 5,803,877 | A | 9/1998 | Franey |
| 5,803,882 | A | 9/1998 | Habing et al. |
| 5,807,210 | A | 9/1998 | Devlin |
| 5,810,696 | A | 9/1998 | Webb |
| 5,810,697 | A | 9/1998 | Joiner |
| 5,810,698 | A | 9/1998 | Hullett et al. |
| 5,813,142 | A | 9/1998 | Demon |
| 5,813,947 | A | 9/1998 | Densmore |
| 5,813,953 | A | 9/1998 | Whipple |
| 5,816,981 | A | 10/1998 | Hung |
| 5,820,478 | A | 10/1998 | Wood et al. |
| 5,823,618 | A | 10/1998 | Fox et al. |
| 5,827,155 | A | 10/1998 | Jensen et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,839,990 | A | 11/1998 | Virkkala |
| 5,839,993 | A | 11/1998 | Fox |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,868,108 | A | 2/1999 | Schmitz et al. |
| 5,868,648 | A | 2/1999 | Coody et al. |
| 5,871,421 | A | 2/1999 | Trulaske et al. |
| 5,876,095 | A | 3/1999 | Johnston |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,895,339 | A | 4/1999 | Maresh |
| 5,895,340 | A | 4/1999 | Keller |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,906,269 | A | 5/1999 | Zabron et al. |
| 5,906,564 | A | 5/1999 | Jacobsen |
| 5,910,070 | A | 6/1999 | Henry et al. |
| 5,910,072 | A | 6/1999 | Rawls et al. |
| 5,911,132 | A | 6/1999 | Sloane |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,925,001 | A | 7/1999 | Hoyt et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,807 | A | 8/1999 | Cassidy |
| 5,943,794 | A | 8/1999 | Gelsomini |
| 5,944,641 | A | 8/1999 | Habing |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,957,814 | A | 9/1999 | Eschenbach |
| 5,961,423 | A | 10/1999 | Sellers |
| 5,961,430 | A | 10/1999 | Zuckerman et al. |
| 5,964,339 | A * | 10/1999 | Matsuura ..... B65G 39/16 198/807 |
| 5,967,944 | A | 10/1999 | Vittone et al. |
| 5,967,954 | A | 10/1999 | Habing |
| 5,967,955 | A | 10/1999 | Westfall et al. |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,839 | A | 11/1999 | Corkum |
| 5,989,161 | A | 11/1999 | Wang et al. |
| 5,989,163 | A | 11/1999 | Rodgers, Jr. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 6,003,481 | A | 12/1999 | Pischinger et al. |
| 6,004,244 | A | 12/1999 | Simonson |
| 6,006,379 | A | 12/1999 | Hensley |
| 6,010,432 | A | 1/2000 | Vawter |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,027,429 | A | 2/2000 | Daniels |

(56) References Cited

U.S. PATENT DOCUMENTS

| | | | |
|---|---|---|---|
| 6,027,430 | A | 2/2000 | Stearns et al. |
| 6,027,432 | A | 2/2000 | Cheng |
| 6,029,858 | A | 2/2000 | Srokose |
| 6,030,320 | A | 2/2000 | Stearns |
| 6,030,321 | A | 2/2000 | Fuentes |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,844 | A | 4/2000 | Clem |
| 6,053,847 | A | 4/2000 | Stearns et al. |
| 6,053,848 | A | 4/2000 | Eschenbach |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,063,009 | A | 5/2000 | Stearns |
| 6,066,075 | A | 5/2000 | Poulton |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,520 | A | 7/2000 | Rodriquez |
| 6,090,014 | A | 7/2000 | Eschenbach |
| 6,090,016 | A | 7/2000 | Kuo |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,110,076 | A | 8/2000 | Hurt |
| 6,110,077 | A | 8/2000 | Yu |
| 6,113,188 | A | 9/2000 | Stewart et al. |
| 6,113,522 | A | 9/2000 | Montgomery |
| 6,117,049 | A | 9/2000 | Lowe |
| 6,120,421 | A | 9/2000 | Kuo |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,129,962 | A | 10/2000 | Quigley et al. |
| 6,132,314 | A | 10/2000 | Aiki |
| 6,132,340 | A | 10/2000 | Wang |
| 6,135,924 | A | 10/2000 | Gibbs et al. |
| 6,135,925 | A | 10/2000 | Liu |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,162,183 | A | 12/2000 | Hoover |
| 6,163,451 | A | 12/2000 | Chiu |
| 6,165,107 | A | 12/2000 | Birrell |
| 6,168,551 | B1 | 1/2001 | Mcguinness |
| 6,171,216 | B1 | 1/2001 | Wang |
| 6,174,267 | B1 | 1/2001 | Dalebout |
| 6,174,268 | B1 | 1/2001 | Novak |
| 6,176,814 | B1 | 1/2001 | Ryan et al. |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,203,474 | B1 | 3/2001 | Jones |
| 6,206,795 | B1 | 3/2001 | Ou |
| 6,210,305 | B1 | 4/2001 | Eschenbach |
| 6,213,919 | B1 | 4/2001 | Wang |
| 6,215,870 | B1 | 4/2001 | Hirai et al. |
| 6,217,487 | B1 | 4/2001 | Reinert |
| 6,220,990 | B1 | 4/2001 | Crivello |
| 6,220,995 | B1 | 4/2001 | Chen |
| 6,224,516 | B1 | 5/2001 | Disch |
| 6,224,519 | B1 | 5/2001 | Doolittle |
| 6,230,047 | B1 | 5/2001 | McHugh |
| 6,230,460 | B1 | 5/2001 | Huyett |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,638 | B1 | 6/2001 | Hurt |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,515 | B1 | 7/2001 | Carman et al. |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,896 | B1 | 9/2001 | Grunfeld |
| 6,287,240 | B1 | 9/2001 | Trabbic |
| 6,293,375 | B1 | 9/2001 | Chen |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,312,363 | B1 | 11/2001 | Watterson et al. |
| 6,314,667 | B1 | 11/2001 | Rife et al. |
| 6,315,486 | B1 | 11/2001 | Lunz |
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |

(56) References Cited

U.S. PATENT DOCUMENTS 6,328,676 B1 12/2001 Alessandri
6,328,677 B1 12/2001 Drapeau
6,334,624 B1 1/2002 Giglio
6,344,986 B1 2/2002 Jain et al.
6,347,603 B1 2/2002 Felger
6,348,028 B1 2/2002 Cragg
6,350,218 B1 2/2002 Dalebout et al.
6,352,494 B2 3/2002 McAlonan
6,357,077 B1 3/2002 Jones, Jr. et al.
6,361,476 B1 3/2002 Eschenbach
6,368,252 B1 4/2002 Stearns
6,368,254 B1 4/2002 Wall
6,371,738 B2 4/2002 Jones
6,371,895 B1 4/2002 Endelman et al.
6,375,580 B1 4/2002 Schmidt
6,379,289 B1 4/2002 Gossie
6,382,627 B1 5/2002 Lundberg
6,383,120 B1 5/2002 Lo
6,387,015 B1 5/2002 Watson
6,387,016 B1 5/2002 Lo
6,390,953 B1 5/2002 Maresh
6,390,955 B1 5/2002 Wang
6,394,239 B1 5/2002 Carlson
6,397,797 B1 6/2002 Kolmanovsky et al.
6,398,695 B2 6/2002 Miller
6,402,666 B2 6/2002 Krull
6,409,632 B1 6/2002 Eschenbach
6,409,633 B1 6/2002 Abelbeck
6,413,197 B2 7/2002 McKechnie et al.
6,416,442 B1 7/2002 Stearns et al.
6,416,444 B1 7/2002 Lim
6,419,611 B1 7/2002 Levine et al.
6,422,976 B1 7/2002 Eschenbach
6,422,977 B1 7/2002 Eschenbach
6,422,983 B1 7/2002 Weck
6,428,449 B1 8/2002 Apseloff
6,430,997 B1 8/2002 French et al.
6,432,026 B1 8/2002 Wang
6,435,466 B1 8/2002 Adams
6,436,007 B1 8/2002 Eschenbach
6,436,008 B1 8/2002 Skowronski et al.
6,440,013 B1 8/2002 Brown
6,440,042 B2 8/2002 Eschenbach
6,443,875 B1 9/2002 Golen, Jr. et al.
6,447,424 B1 9/2002 Ashby et al.
6,447,430 B1 9/2002 Webb et al.
6,450,284 B1 9/2002 Sakyo et al.
6,450,922 B1 9/2002 Henderson et al.
6,450,923 B1 9/2002 Vatti
6,450,925 B1 9/2002 Kuo
6,454,679 B1 9/2002 Radow
6,454,682 B1 9/2002 Kuo
6,455,960 B1 9/2002 Trago et al.
6,457,709 B1 * 10/2002 Madsen ..... B65H 5/021 271/198
6,458,060 B1 10/2002 Watterson et al.
6,461,275 B1 10/2002 Wang et al.
6,461,279 B1 10/2002 Kuo
6,466,460 B1 10/2002 Rein et al.
6,468,189 B2 10/2002 Alessandri
6,471,622 B1 10/2002 Hammer et al.
6,475,121 B2 11/2002 Wang
6,478,721 B1 11/2002 Hunter
6,482,128 B1 11/2002 Michalow
6,482,130 B1 11/2002 Pasero et al.
6,482,132 B2 11/2002 Eschenbach
6,485,397 B1 11/2002 Manderbacka
6,488,020 B1 12/2002 Rosas-Magallan
6,491,610 B1 12/2002 Henn
6,494,814 B1 12/2002 Wang
6,494,817 B2 12/2002 Lake
6,500,097 B1 12/2002 Hall
6,503,173 B2 1/2003 Clem
6,505,503 B1 1/2003 Teresi et al.
6,513,532 B2 2/2003 Mault et al.
6,513,669 B2 2/2003 Ozawa et al.
6,514,180 B1 2/2003 Rawls
6,520,891 B1 2/2003 Stephens, Jr.
6,527,674 B1 3/2003 Clem
6,527,678 B1 3/2003 Wang
6,527,685 B2 3/2003 Endelman et al.
6,527,796 B1 3/2003 Magovern
6,530,864 B1 3/2003 Parks
6,533,707 B2 3/2003 Wang
6,537,184 B2 3/2003 Kim
6,539,931 B2 4/2003 Trajkovic et al.
6,543,247 B2 4/2003 Strauss
6,544,146 B1 4/2003 Stearns et al.
6,547,701 B1 4/2003 Eschenbach
6,547,702 B1 4/2003 Heidecke
6,551,218 B2 4/2003 Goh
6,551,223 B2 4/2003 Cheng
6,554,749 B2 4/2003 Iund et al.
6,558,299 B1 5/2003 Slattery
6,558,301 B1 5/2003 Jackson
6,561,960 B2 5/2003 Webber
6,563,489 B1 5/2003 Latypov et al.
6,569,061 B2 5/2003 Stearns et al.
6,569,062 B2 5/2003 Wang
6,572,511 B1 6/2003 Volpe
6,572,512 B2 6/2003 Anderson et al.
6,572,513 B1 6/2003 Whan-Tong et al.
6,575,878 B1 6/2003 Choy
6,579,210 B1 6/2003 Stearns et al.
6,579,211 B2 6/2003 Wu
6,582,342 B2 6/2003 Kaufman
6,582,344 B2 6/2003 Tang
6,585,624 B1 7/2003 Chen
6,585,626 B2 7/2003 McBride
6,589,138 B2 7/2003 Dyer et al.
6,592,502 B1 7/2003 Phillips
6,599,223 B2 7/2003 Wang
6,601,016 B1 7/2003 Brown et al.
6,601,358 B2 8/2003 Panatta
6,601,825 B2 8/2003 Bressner et al.
6,604,008 B2 8/2003 Chudley et al.
6,605,020 B1 8/2003 Huang
6,609,478 B2 8/2003 Del Valle
6,610,063 B2 8/2003 Kumar et al.
6,612,969 B2 9/2003 Eschenbach
6,612,971 B1 9/2003 Morris
6,619,681 B2 9/2003 Gutierrez
6,620,079 B2 9/2003 Kuo
6,623,407 B2 9/2003 Novak
6,623,409 B1 9/2003 Abelbeck
6,626,799 B2 9/2003 Watterson et al.
6,626,802 B1 9/2003 Rodgers, Jr.
6,626,803 B1 9/2003 Oglesby et al.
6,629,902 B2 10/2003 Murphy et al.
6,629,909 B1 10/2003 Stearns et al.
6,629,910 B1 10/2003 Krull
6,632,161 B1 10/2003 Nir
6,634,996 B2 10/2003 Jacobsen
6,637,811 B2 10/2003 Zheng
6,637,818 B2 10/2003 Williams
6,645,125 B1 11/2003 Stearns et al.
6,645,126 B1 11/2003 Martin et al.
6,645,130 B2 11/2003 Webber
6,648,800 B2 11/2003 Stearns et al.
6,648,801 B2 11/2003 Stearns et al.
6,648,802 B2 11/2003 Ware
6,652,424 B2 11/2003 Dalebout
6,652,425 B1 11/2003 Martin et al.
6,652,429 B2 11/2003 Bushnell
6,660,949 B2 12/2003 Kamino et al.
6,661,136 B1 12/2003 Lee
6,663,127 B2 12/2003 Miller
6,663,498 B2 12/2003 Stipan
6,663,500 B2 12/2003 Huang
6,666,800 B2 12/2003 Krull
6,666,801 B1 12/2003 Michalow
6,668,678 B1 12/2003 Baba et al.
6,669,600 B2 12/2003 Warner
6,669,609 B2 12/2003 Gerschefske et al.

(56) References Cited

U.S. PATENT DOCUMENTS 6,671,975 B2 1/2004 Hennessey
6,672,991 B2 1/2004 O'Malley
6,672,992 B1 1/2004 Lo et al.
6,672,994 B1 1/2004 Stearns et al.
6,676,530 B2 1/2004 Lochtefeld
6,676,572 B2 1/2004 Wang
6,676,579 B1 1/2004 Lin
6,679,816 B1 1/2004 Krull
6,679,820 B2 1/2004 Barkus et al.
6,681,704 B1 1/2004 Brookhiser
6,681,728 B2 1/2004 Haghgooie
6,682,460 B2 1/2004 Lo
6,682,461 B2 1/2004 Wang
6,685,169 B2 2/2004 Shim
6,685,601 B1 2/2004 Knapp
6,685,602 B2 2/2004 Colosky, Jr. et al.
6,685,607 B1 2/2004 Olson
6,689,019 B2 2/2004 Ohrt et al.
6,689,020 B2 2/2004 Stearns
6,689,075 B2 2/2004 West
6,695,694 B2 2/2004 Ishikawa et al.
6,698,110 B1 3/2004 Robbins
6,699,159 B2 3/2004 Rouse
6,699,162 B2 3/2004 Chen
6,702,719 B1 3/2004 Brown et al.
6,705,977 B1 3/2004 Ziak
6,708,427 B2 3/2004 Sussmann et al.
6,712,737 B1 3/2004 Nusbaum
6,716,142 B2 4/2004 Kuo
6,716,144 B1 4/2004 Shifferaw
6,719,667 B2 4/2004 Wong et al.
6,719,669 B1 4/2004 Wang
6,723,413 B2 4/2004 Walters
6,726,600 B2 4/2004 Miller
6,726,601 B1 4/2004 Beutel
6,726,602 B2 4/2004 Chang
6,730,002 B2 5/2004 Hald et al.
6,733,423 B1 5/2004 Chang
6,733,424 B2 5/2004 Krull
6,736,360 B1 5/2004 Buczek
6,738,274 B2 5/2004 Prasad et al.
6,740,009 B1 5/2004 Hall
6,741,052 B2 5/2004 Fitzgibbon
6,743,153 B2 6/2004 Watterson et al.
6,746,371 B1 6/2004 Brown et al.
6,747,427 B1 6/2004 Carson
6,749,540 B1 6/2004 Pasero et al.
6,749,542 B2 6/2004 Wu
6,758,790 B1 7/2004 Ellis
6,758,791 B1 7/2004 Kuo
6,758,792 B1 7/2004 Chang
6,761,387 B2 7/2004 Sloss
6,761,667 B1 7/2004 Cutler et al.
6,764,429 B1 7/2004 Michalow
6,764,430 B1 7/2004 Fencel
6,764,431 B2 7/2004 Yoss
6,765,726 B2 7/2004 French et al.
6,767,314 B2 7/2004 Thompson
6,770,015 B2 8/2004 Simonson
6,776,740 B1 8/2004 Anderson et al.
6,778,938 B1 8/2004 Ng et al.
6,783,134 B2 8/2004 Geary
6,783,482 B2 8/2004 Oglesby et al.
6,786,821 B2 9/2004 Nobe et al.
6,786,847 B1 9/2004 Morgan et al.
6,786,848 B2 9/2004 Yamashita et al.
6,786,850 B2 9/2004 Nizamuddin
6,786,852 B2 9/2004 Watterson et al.
6,790,162 B1 9/2004 Ellis et al.
6,793,607 B2 9/2004 Neil
6,793,609 B1 9/2004 Fan
6,796,159 B2 9/2004 Kelm et al.
6,796,927 B2 9/2004 Toyama
6,800,050 B2 10/2004 Moavro
6,807,869 B2 10/2004 Farringdon et al.
6,808,458 B1 10/2004 Jung
6,808,475 B2 10/2004 Kehrbaum
6,811,519 B2 11/2004 Kuo
6,811,520 B2 11/2004 Wu
6,817,117 B1 11/2004 Campbell
6,817,968 B2 11/2004 Galbraith et al.
6,821,230 B2 11/2004 Dalebout et al.
6,824,210 B2 11/2004 Zheng
6,824,502 B1 11/2004 Huang
6,830,540 B2 12/2004 Watterson
6,830,541 B2 12/2004 Wu
6,835,166 B1 12/2004 Stearns et al.
6,837,829 B2 1/2005 Eschenbach
6,837,830 B2 1/2005 Eldridge
6,837,838 B2 1/2005 List
6,840,892 B1 1/2005 Wu
6,842,928 B2 1/2005 Yang et al.
6,843,732 B1 1/2005 Huang
6,843,757 B2 1/2005 Pan et al.
6,846,272 B2 1/2005 Rosenow et al.
6,849,032 B2 2/2005 Chu
6,852,050 B2 * 2/2005 Sands ..... B65G 39/16
198/810.03
6,852,068 B2 2/2005 Ogawa
6,852,069 B2 2/2005 Park
6,855,093 B2 2/2005 Anderson et al.
6,855,097 B2 2/2005 Krull
6,857,993 B2 2/2005 Yeh
6,860,836 B1 3/2005 Wu
6,860,839 B1 3/2005 Dice
6,866,141 B2 3/2005 Saeki
6,872,168 B2 3/2005 Wang et al.
6,872,175 B2 3/2005 Lin
6,875,157 B1 4/2005 Wang
6,875,160 B2 4/2005 Watterson et al.
6,878,099 B2 4/2005 Corbalis et al.
6,878,101 B2 4/2005 Colley
6,880,416 B2 4/2005 Koch
6,880,487 B2 4/2005 Reinkensmeyer et al.
6,881,176 B2 4/2005 Oishi et al.
6,887,185 B1 5/2005 Kuo
6,887,190 B1 5/2005 Azari
6,893,383 B1 5/2005 Chang et al.
6,896,645 B1 5/2005 Krull
6,899,657 B2 5/2005 Chuang
6,899,659 B2 5/2005 Anderson et al.
6,902,513 B1 6/2005 Mcclure
6,902,515 B2 6/2005 Howell et al.
6,905,446 B2 6/2005 Greenland
6,908,416 B2 6/2005 Mercado et al.
6,908,417 B2 6/2005 Jackson
6,910,991 B2 6/2005 Matsumoto
6,913,562 B2 7/2005 Chen
6,913,563 B2 7/2005 Chen
6,916,278 B2 7/2005 Webber
6,918,858 B2 7/2005 Watterson et al.
6,918,859 B1 7/2005 Yeh
6,918,860 B1 7/2005 Nusbaum
6,920,947 B2 7/2005 Kamen et al.
6,921,354 B1 7/2005 Shifferaw
6,921,355 B2 7/2005 Campanaro et al.
6,923,746 B1 8/2005 Skowronski et al.
6,923,747 B1 8/2005 Chu
6,926,644 B2 8/2005 Chen
6,926,646 B1 8/2005 Nguyen
6,932,745 B1 8/2005 Ellis
6,939,271 B1 9/2005 Whan-Tong et al.
6,944,294 B2 9/2005 Tsay
6,945,912 B2 9/2005 Levi
6,945,917 B1 9/2005 Baatz
6,949,053 B1 9/2005 Stearns
6,949,054 B1 9/2005 Stearns
6,953,418 B1 10/2005 Chen
6,953,424 B2 10/2005 Kusumoto et al.
6,964,632 B1 11/2005 Ko
6,966,872 B2 11/2005 Eschenbach
6,974,404 B1 12/2005 Watterson et al.
6,976,698 B2 12/2005 Kuiken
6,979,283 B2 12/2005 Pan

(56) References Cited

U.S. PATENT DOCUMENTS

| | | | |
|---|---|---|---|
| 6,991,588 | B1 | 1/2006 | Adams |
| 6,993,270 | B2 | 1/2006 | Yoshioka et al. |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,003,828 | B2 | 2/2006 | Roussy |
| 7,004,271 | B1 | 2/2006 | Kamen et al. |
| 7,004,887 | B2 | 2/2006 | Pan et al. |
| 7,004,888 | B1 | 2/2006 | Weng |
| 7,004,895 | B2 | 2/2006 | Perry |
| 7,008,352 | B2 | 3/2006 | Grossi |
| 7,008,359 | B2 | 3/2006 | Fan et al. |
| 7,009,613 | B2 | 3/2006 | Goden |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,014,599 | B2 | 3/2006 | Ashley |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,032,870 | B2 | 4/2006 | Sweere et al. |
| 7,033,176 | B2 | 4/2006 | Feldman |
| 7,033,269 | B2 | 4/2006 | Namba et al. |
| 7,033,306 | B2 | 4/2006 | Graber |
| 7,037,241 | B2 | 5/2006 | Kuo |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,047,817 | B2 | 5/2006 | Lanham |
| 7,052,426 | B2 | 5/2006 | Battat et al. |
| 7,052,440 | B2 | 5/2006 | Pyles et al. |
| 7,052,442 | B2 | 5/2006 | Watterson |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,060,007 | B2 | 6/2006 | Juva |
| 7,060,008 | B2 | 6/2006 | Watterson et al. |
| 7,060,012 | B2 | 6/2006 | Howell et al. |
| 7,070,415 | B2 | 7/2006 | Hojo et al. |
| 7,070,542 | B2 | 7/2006 | Reyes et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,069 | B2 | 7/2006 | Hsu |
| 7,081,073 | B1 | 7/2006 | Smith |
| 7,082,703 | B2 | 8/2006 | Greene et al. |
| 7,083,546 | B2 | 8/2006 | Zillig |
| 7,083,582 | B2 | 8/2006 | Chen |
| 7,086,994 | B2 | 8/2006 | Turak et al. |
| 7,086,995 | B2 | 8/2006 | Reyes |
| 7,090,621 | B2 | 8/2006 | Loane |
| 7,090,622 | B2 | 8/2006 | Hetrick |
| 7,097,591 | B2 | 8/2006 | Moon |
| 7,097,593 | B2 | 8/2006 | Chang |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,930 | B2 | 9/2006 | Lo et al. |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,112,161 | B2 | 9/2006 | Maresh |
| 7,115,073 | B2 | 10/2006 | Nizamuddin |
| 7,125,371 | B2 | 10/2006 | Henderson |
| 7,132,939 | B2 | 11/2006 | Tyndall et al. |
| 7,140,487 | B2 | 11/2006 | Motoda |
| 7,140,626 | B1 | 11/2006 | Keay |
| 7,141,005 | B2 | 11/2006 | Wu |
| 7,141,008 | B2 | 11/2006 | Krull et al. |
| 7,147,591 | B2 | 12/2006 | McAvoy |
| 7,156,776 | B2 | 1/2007 | Maser |
| 7,163,488 | B2 | 1/2007 | Anders |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,172,531 | B2 | 2/2007 | Rodgers, Jr. |
| 7,175,193 | B2 | 2/2007 | Wu |
| 7,179,204 | B2 | 2/2007 | Anderson et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,186,189 | B2 | 3/2007 | Huang |
| 7,188,439 | B2 | 3/2007 | DiBenedetto et al. |
| 7,189,190 | B2 | 3/2007 | Lamar et al. |
| 7,192,387 | B2 | 3/2007 | Mendel |
| 7,192,388 | B2 | 3/2007 | Dalebout et al. |
| 7,195,568 | B2 | 3/2007 | Huang |
| 7,196,491 | B2 | 3/2007 | Mayhew et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,211,029 | B2 | 5/2007 | Kau |
| 7,214,167 | B2 | 5/2007 | Stearns |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,216 | B1 | 5/2007 | McBride |
| 7,225,694 | B2 | 6/2007 | Said |
| 7,226,402 | B1 | 6/2007 | Joya |
| 7,234,200 | B2 | 6/2007 | Chase |
| 7,235,942 | B2 | 6/2007 | Nagaoka et al. |
| 7,238,147 | B2 | 7/2007 | Mills et al. |
| 7,247,128 | B2 | 7/2007 | Oga |
| 7,250,022 | B2 | 7/2007 | Dalebout |
| 7,257,468 | B1 | 8/2007 | Costa et al. |
| 7,258,039 | B2 | 8/2007 | Lin |
| 7,258,651 | B2 | 8/2007 | Clarke |
| 7,260,950 | B2 | 8/2007 | Choi et al. |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,955 | B2 | 10/2007 | Giannelli et al. |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,291,100 | B2 | 11/2007 | Dodge |
| 7,292,151 | B2 | 11/2007 | Ferguson |
| 7,293,510 | B1 | 11/2007 | Siao et al. |
| 7,294,094 | B1 | 11/2007 | Howle |
| 7,294,100 | B2 | 11/2007 | Bull |
| 7,303,508 | B2 | 12/2007 | Toyama et al. |
| 7,303,510 | B2 | 12/2007 | Gebhardt |
| 7,311,640 | B2 | 12/2007 | Baatz |
| 7,316,633 | B2 | 1/2008 | Liao et al. |
| 7,319,457 | B2 | 1/2008 | Lin et al. |
| 7,322,653 | B2 | 1/2008 | Dragusin |
| 7,322,907 | B2 | 1/2008 | Bowser |
| 7,329,212 | B2 | 2/2008 | Roque |
| 7,331,227 | B2 | 2/2008 | Kang et al. |
| 7,334,350 | B2 | 2/2008 | Ellis, III |
| 7,335,135 | B2 | 2/2008 | Wang |

(56) References Cited

U.S. PATENT DOCUMENTS

| | | | |
|---|---|---|---|
| 7,335,139 | B2 | 2/2008 | Bartholomew et al. |
| 7,335,140 | B2 | 2/2008 | Webber et al. |
| 7,335,147 | B2 | 2/2008 | Jones |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,125 | B2 | 4/2008 | Webber et al. |
| 7,362,016 | B2 | 4/2008 | Cheng |
| 7,364,538 | B2 | 4/2008 | Aucamp |
| 7,366,921 | B2 | 4/2008 | Ranganathan |
| 7,367,926 | B2 | 5/2008 | Clark |
| 7,367,957 | B2 | 5/2008 | Huang et al. |
| 7,369,121 | B2 | 5/2008 | Lane |
| 7,374,522 | B2 | 5/2008 | Arnold |
| 7,377,881 | B2 | 5/2008 | Moon |
| 7,377,882 | B2 | 5/2008 | Watterson |
| 7,381,161 | B2 | 6/2008 | Ellis |
| 7,384,013 | B2 | 6/2008 | Yen |
| 7,393,308 | B1 | 7/2008 | Huang |
| 7,402,145 | B1 | 7/2008 | Woggon |
| 7,404,232 | B2 | 7/2008 | Chase |
| 7,410,449 | B2 | 8/2008 | Yeh |
| 7,413,532 | B1 | 8/2008 | Monsrud et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,203 | B2 | 10/2008 | Anderson et al. |
| 7,435,205 | B2 | 10/2008 | Reyes et al. |
| 7,455,621 | B1 | 11/2008 | Anthony |
| 7,455,626 | B2 | 11/2008 | Trevino et al. |
| 7,455,628 | B1 | 11/2008 | Stearns |
| 7,461,825 | B2 | 12/2008 | Olivera |
| 7,462,135 | B2 | 12/2008 | Lo |
| 7,470,234 | B1 | 12/2008 | Elhag et al. |
| 7,473,211 | B2 | 1/2009 | Lee |
| 7,475,613 | B2 | 1/2009 | Bailey |
| 7,485,076 | B2 | 2/2009 | Lee |
| 7,488,277 | B1 | 2/2009 | Knapp |
| 7,491,154 | B2 | 2/2009 | Yonehana et al. |
| 7,494,450 | B2 | 2/2009 | Solomon |
| 7,494,454 | B2 | 2/2009 | Sheets |
| 7,497,784 | B2 | 3/2009 | Henry |
| 7,497,806 | B2 | 3/2009 | Duncan et al. |
| 7,507,183 | B2 | 3/2009 | Anderson |
| 7,507,187 | B2 | 3/2009 | Dyer et al. |
| 7,507,189 | B2 | 3/2009 | Krull |
| 7,510,508 | B2 | 3/2009 | Santomassimo et al. |
| 7,510,511 | B2 | 3/2009 | Von Detten |
| 7,511,710 | B2 | 3/2009 | Barrett |
| 7,517,303 | B2 | 4/2009 | Crawford et al. |
| 7,520,840 | B2 | 4/2009 | Shifferaw |
| 7,524,272 | B2 | 4/2009 | Bruck et al. |
| 7,525,293 | B1 | 4/2009 | Notohamiprodjo et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,552 | B2 | 5/2009 | Dalebout et al. |
| 7,540,828 | B2 | 6/2009 | Watterson et al. |
| 7,540,829 | B1 | 6/2009 | Chen |
| 7,542,040 | B2 | 6/2009 | Templeman |
| 7,544,153 | B2 | 6/2009 | Trevino et al. |
| 7,547,255 | B2 | 6/2009 | Lochtefeld et al. |
| 7,549,938 | B2 | 6/2009 | Leighton et al. |
| 7,549,947 | B2 | 6/2009 | Hickman et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,563,235 | B2 | 7/2009 | Der Meer |
| 7,569,000 | B2 | 8/2009 | Wang |
| 7,569,004 | B2 | 8/2009 | Kolomeir |
| 7,572,206 | B2 | 8/2009 | Wilkins et al. |
| 7,575,537 | B2 | 8/2009 | Ellis |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,588,520 | B2 | 9/2009 | Nalley |
| 7,591,770 | B2 | 9/2009 | Stewart et al. |
| 7,591,795 | B2 | 9/2009 | Whalen et al. |
| 7,594,873 | B2 | 9/2009 | Terao et al. |
| 7,594,877 | B2 | 9/2009 | Anderson et al. |
| 7,594,878 | B1 | 9/2009 | Joannou |
| 7,594,880 | B2 | 9/2009 | Webber |
| 7,601,101 | B2 | 10/2009 | Jackson et al. |
| 7,602,301 | B1 | 10/2009 | Stirling et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,608,015 | B2 | 10/2009 | Radow |
| 7,608,021 | B1 | 10/2009 | Nalley |
| 7,608,023 | B2 | 10/2009 | Casagrande |
| 7,608,028 | B2 | 10/2009 | Pertegaz-Esteban |
| 7,614,639 | B2 | 11/2009 | Tholkes et al. |
| 7,614,981 | B2 | 11/2009 | Cao |
| 7,614,991 | B2 | 11/2009 | Fox |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,621,850 | B2 | 11/2009 | Piaget et al. |
| 7,621,855 | B1 | 11/2009 | Krull |
| 7,625,314 | B2 | 12/2009 | Ungari |
| 7,625,315 | B2 | 12/2009 | Hickman |
| 7,625,319 | B2 | 12/2009 | Kang et al. |
| 7,628,730 | B1 | 12/2009 | Watterson et al. |
| 7,628,732 | B1 | 12/2009 | Porszasz et al. |
| 7,628,733 | B2 | 12/2009 | Donner |
| 7,630,201 | B2 | 12/2009 | Asahi |
| 7,637,847 | B1 | 12/2009 | Hickman |
| 7,637,850 | B2 | 12/2009 | Chen |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,215 | B2 | 1/2010 | Gordon |
| 7,645,218 | B2 | 1/2010 | Potok et al. |
| 7,647,196 | B2 | 1/2010 | Kahn et al. |
| 7,648,441 | B2 | 1/2010 | Silk |
| 7,648,443 | B2 | 1/2010 | Schenk |
| 7,648,446 | B2 | 1/2010 | Chiles et al. |
| 7,650,987 | B2 | 1/2010 | Taniguchi et al. |
| 7,651,442 | B2 | 1/2010 | Carlson |
| 7,651,450 | B2 | 1/2010 | Wehrell |
| 7,654,229 | B2 | 2/2010 | Smith |
| 7,654,938 | B2 | 2/2010 | Webber et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,665,794 | B2 | 2/2010 | Kachouh |
| 7,670,263 | B2 | 3/2010 | Ellis |
| 7,674,205 | B2 | 3/2010 | Dalebout et al. |
| 7,674,206 | B2 | 3/2010 | Jones |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,686,742 | B2 | 3/2010 | Tischler |
| 7,690,317 | B2 | 4/2010 | Beck et al. |
| 7,690,556 | B1 | 4/2010 | Kahn et al. |
| 7,691,031 | B2 | 4/2010 | Toyama et al. |
| 7,691,069 | B2 | 4/2010 | Adams |
| 7,695,406 | B2 | 4/2010 | Waters |
| 7,695,409 | B2 | 4/2010 | Decathlon |

(56) References Cited

U.S. PATENT DOCUMENTS

| | | | |
|---|---|---|---|
| 7,704,191 | B2 | 4/2010 | Smith et al. |
| 7,704,192 | B2 | 4/2010 | Dyer et al. |
| 7,704,199 | B2 | 4/2010 | Koch |
| 7,706,547 | B2 | 4/2010 | Luo |
| 7,708,668 | B2 | 5/2010 | Rodgers, Jr. |
| 7,708,670 | B2 | 5/2010 | Bowser |
| 7,708,672 | B2 | 5/2010 | Gibson et al. |
| 7,713,172 | B2 | 5/2010 | Watterson et al. |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,829 | B2 | 5/2010 | Wang |
| 7,717,830 | B1 | 5/2010 | Charniga et al. |
| 7,722,503 | B1 | 5/2010 | Smith et al. |
| 7,722,507 | B2 | 5/2010 | Yoo |
| 7,722,509 | B2 | 5/2010 | Eder |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,740,562 | B2 | 6/2010 | Jones |
| 7,740,563 | B2 | 6/2010 | Dalebout et al. |
| 7,741,975 | B2 | 6/2010 | Shum et al. |
| 7,745,716 | B1 | 6/2010 | Murphy |
| 7,749,137 | B2 | 7/2010 | Watt et al. |
| 7,749,138 | B2 | 7/2010 | Wang |
| 7,753,824 | B2 | 7/2010 | Wang |
| 7,753,830 | B1 | 7/2010 | Marsh et al. |
| 7,753,861 | B1 | 7/2010 | Kahn et al. |
| 7,757,346 | B2 | 7/2010 | Chase |
| 7,758,469 | B2 | 7/2010 | Dyer et al. |
| 7,758,470 | B2 | 7/2010 | Hirata et al. |
| 7,758,478 | B2 | 7/2010 | Golesh et al. |
| 7,761,212 | B2 | 7/2010 | Takebayashi |
| 7,762,935 | B2 | 7/2010 | Doble |
| 7,762,952 | B2 | 7/2010 | Lee et al. |
| 7,764,990 | B2 | 7/2010 | Martikka et al. |
| 7,766,797 | B2 | 8/2010 | Dalebout |
| 7,771,319 | B1 | 8/2010 | Spoeth, Jr. et al. |
| 7,771,320 | B2 | 8/2010 | Riley et al. |
| 7,771,329 | B2 | 8/2010 | Dalebout et al. |
| 7,771,371 | B2 | 8/2010 | Avni |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,577 | B2 | 8/2010 | Arnold |
| 7,780,578 | B2 | 8/2010 | Packham |
| 7,785,232 | B2 | 8/2010 | Cole et al. |
| 7,789,800 | B1 | 9/2010 | Watterson et al. |
| 7,794,363 | B2 | 9/2010 | Wang |
| 7,795,824 | B2 | 9/2010 | Shen et al. |
| 7,805,186 | B2 | 9/2010 | Pulkkinen et al. |
| 7,806,006 | B2 | 10/2010 | Phillips et al. |
| 7,806,780 | B1 | 10/2010 | Plunkett |
| 7,806,805 | B2 | 10/2010 | Barufka et al. |
| 7,811,209 | B2 | 10/2010 | Crawford et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,779 | B2 | 10/2010 | Chang |
| 7,825,319 | B2 | 11/2010 | Turner |
| 7,828,699 | B2 | 11/2010 | P Erez De Lazarraga |
| 7,833,135 | B2 | 11/2010 | Radow |
| 7,837,161 | B2 | 11/2010 | Chase |
| 7,837,595 | B2 | 11/2010 | Rice |
| 7,839,058 | B1 | 11/2010 | Churchill et al. |
| 7,846,070 | B2 | 12/2010 | Oglesby et al. |
| 7,850,514 | B2 | 12/2010 | Weber |
| 7,850,537 | B2 | 12/2010 | Stern |
| 7,854,669 | B2 | 12/2010 | Marty et al. |
| 7,854,690 | B2 | 12/2010 | Trevino et al. |
| 7,862,475 | B2 | 1/2011 | Watterson |
| 7,862,483 | B2 | 1/2011 | Hendrickson et al. |
| 7,871,355 | B2 | 1/2011 | Yeh |
| 7,871,357 | B2 | 1/2011 | Gibson et al. |
| 7,873,849 | B2 | 1/2011 | Mucignat et al. |
| 7,874,963 | B2 | 1/2011 | Grind |
| 7,878,950 | B1 | 2/2011 | Bastian |
| 7,878,956 | B2 | 2/2011 | Kadar |
| 7,883,445 | B2 | 2/2011 | Olrik et al. |
| 7,883,448 | B2 | 2/2011 | Wang |
| 7,887,465 | B2 | 2/2011 | Uffelman |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,892,159 | B2 | 2/2011 | McVay et al. |
| 7,901,324 | B2 | 3/2011 | Kodama |
| 7,901,325 | B2 | 3/2011 | Henderson |
| 7,901,753 | B2 | 3/2011 | Carr |
| 7,905,817 | B2 | 3/2011 | Giannascoli et al. |
| 7,908,981 | B2 | 3/2011 | Agee |
| 7,909,740 | B2 | 3/2011 | Dalebout et al. |
| 7,914,420 | B2 | 3/2011 | Daly et al. |
| 7,914,421 | B2 | 3/2011 | Weier et al. |
| 7,918,768 | B2 | 4/2011 | Rogozinski |
| 7,919,950 | B2 | 4/2011 | Uno et al. |
| 7,922,635 | B2 | 4/2011 | Lull et al. |
| 7,927,253 | B2 | 4/2011 | Vincent |
| 7,927,257 | B2 | 4/2011 | Patel |
| 7,927,267 | B2 | 4/2011 | Splane |
| 7,931,563 | B2 | 4/2011 | Shaw et al. |
| 7,938,751 | B2 | 5/2011 | Nicolas et al. |
| 7,938,755 | B1 | 5/2011 | Dyer et al. |
| 7,941,945 | B2 | 5/2011 | Gerber |
| 7,942,783 | B2 | 5/2011 | Ochi |
| 7,942,788 | B2 | 5/2011 | Wu |
| 7,946,967 | B2 | 5/2011 | Berhanu |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer et al. |
| 7,967,728 | B2 | 6/2011 | Zavadsky |
| 7,967,730 | B2 | 6/2011 | Crawford et al. |
| 7,972,245 | B2 | 7/2011 | Temple et al. |
| 7,972,249 | B1 | 7/2011 | Napalan |
| 7,976,437 | B1 | 7/2011 | Von Detten |
| 7,978,081 | B2 | 7/2011 | Shears et al. |
| 7,985,164 | B2 | 7/2011 | Ashby |
| 7,985,166 | B2 | 7/2011 | Farnsworth et al. |
| 7,988,600 | B2 | 8/2011 | Rodgers, Jr. |
| 7,992,879 | B2 | 8/2011 | Eisenberg et al. |
| 8,001,472 | B2 | 8/2011 | Gilley et al. |
| 8,002,674 | B2 | 8/2011 | Piaget et al. |
| 8,002,684 | B2 | 8/2011 | Laurent |
| 8,006,574 | B2 | 8/2011 | Meyer |
| 8,007,407 | B2 | 8/2011 | Richter |
| 8,007,409 | B2 | 8/2011 | Elllis |
| 8,007,422 | B2 | 8/2011 | Zaccherini |
| 8,009,045 | B2 | 8/2011 | Cehelnik |
| 8,011,242 | B2 | 9/2011 | O'neill |
| 8,012,003 | B2 | 9/2011 | Sterchi et al. |
| 8,012,067 | B2 | 9/2011 | Joannou |
| 8,012,068 | B1 | 9/2011 | Malcolm |
| 8,021,277 | B2 | 9/2011 | Baudhuin |
| 8,025,609 | B2 | 9/2011 | Giannelli et al. |
| 8,029,415 | B2 | 10/2011 | Ashby et al. |
| 8,029,418 | B2 | 10/2011 | Nishimura |
| 8,033,959 | B2 | 10/2011 | Oleson et al. |
| 8,037,574 | B2 | 10/2011 | Chase |
| 8,038,117 | B2 | 10/2011 | Chen et al. |
| 8,038,577 | B2 | 10/2011 | Mcintosh |
| 8,040,117 | B2 | 10/2011 | Telefus |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,055,469 | B2 | 11/2011 | Kulach et al. |
| 8,057,366 | B2 | 11/2011 | Schippers |

(56) References Cited

U.S. PATENT DOCUMENTS

| | | | |
|---|---|---|---|
| 8,057,368 | B1 | 11/2011 | Lyszczarz |
| 8,062,196 | B1 | 11/2011 | Khubani |
| 8,063,776 | B2 | 11/2011 | Ruha |
| 8,065,926 | B2 | 11/2011 | Meyer |
| 8,066,514 | B2 | 11/2011 | Clarke |
| 8,070,657 | B2 | 12/2011 | Loach |
| 8,079,937 | B2 | 12/2011 | Bedell |
| 8,079,939 | B1 | 12/2011 | Wang |
| 8,082,029 | B2 | 12/2011 | Honda |
| 8,083,645 | B2 | 12/2011 | Asukai et al. |
| 8,083,693 | B1 | 12/2011 | Mckeon et al. |
| 8,088,044 | B2 | 1/2012 | Tchao et al. |
| 8,092,352 | B2 | 1/2012 | Irving et al. |
| 8,096,925 | B2 | 1/2012 | Radding et al. |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,213 | B2 | 1/2012 | Stewart et al. |
| 8,109,858 | B2 | 2/2012 | Redmann |
| 8,109,864 | B2 | 2/2012 | Tseng |
| 8,113,990 | B2 | 2/2012 | Kolman et al. |
| 8,113,994 | B2 | 2/2012 | Piaget et al. |
| 8,118,709 | B2 | 2/2012 | Mckirdy |
| 8,118,888 | B2 | 2/2012 | Molter |
| 8,123,527 | B2 | 2/2012 | Holljes |
| 8,141,276 | B2 | 3/2012 | Ellis |
| 8,147,385 | B2 | 4/2012 | Crawford et al. |
| 8,152,702 | B2 | 4/2012 | Pacheco |
| 8,162,769 | B2 | 4/2012 | Henry |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,192,332 | B2 | 6/2012 | Baker et al. |
| 8,192,338 | B2 | 6/2012 | Solow |
| 8,200,323 | B2 | 6/2012 | Dibenedetto et al. |
| 8,206,266 | B2 | 6/2012 | Hall |
| 8,221,290 | B2 | 7/2012 | Vincent et al. |
| 8,221,295 | B2 | 7/2012 | Wilkins |
| 8,235,724 | B2 | 8/2012 | Gilley et al. |
| 8,240,430 | B2 | 8/2012 | Downey |
| 8,241,182 | B2 | 8/2012 | Julskjaer et al. |
| 8,241,186 | B2 | 8/2012 | Brodess et al. |
| 8,241,187 | B2 | 8/2012 | Moon et al. |
| 8,251,874 | B2 | 8/2012 | Ashby et al. |
| 8,260,858 | B2 | 9/2012 | Belz et al. |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,302,213 | B2 | 11/2012 | Kriesel |
| 8,306,635 | B2 | 11/2012 | Pryor |
| 8,309,870 | B2 | 11/2012 | Peterson et al. |
| 8,310,468 | B2 | 11/2012 | Martin |
| 8,315,823 | B2 | 11/2012 | Berme et al. |
| 8,317,663 | B2 | 11/2012 | Stewart et al. |
| 8,320,578 | B2 | 11/2012 | Kahn et al. |
| 8,323,156 | B2 | 12/2012 | Ozawa et al. |
| 8,323,157 | B2 | 12/2012 | Campanaro et al. |
| 8,329,265 | B2 | 12/2012 | Cook |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,376,911 | B2 | 2/2013 | Ogg et al. |
| 8,378,647 | B2 | 2/2013 | Yonezawa et al. |
| 8,394,005 | B2 | 3/2013 | Solow et al. |
| 8,395,366 | B2 | 3/2013 | Uno |
| 8,398,529 | B2 | 3/2013 | Ellis |
| 8,403,816 | B2 | 3/2013 | Park |
| 8,429,223 | B2 | 4/2013 | Gilley et al. |
| 8,435,160 | B1 | 5/2013 | Clum |
| 8,446,275 | B2 | 5/2013 | Utter, II |
| 8,449,620 | B2 | 5/2013 | Hakansson et al. |
| 8,454,437 | B2 | 6/2013 | Dugan |
| 8,459,479 | B2 | 6/2013 | Yourist |
| 8,467,979 | B2 | 6/2013 | Sobolewski |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,944 | B2 | 7/2013 | Drazan |
| 8,485,945 | B2 | 7/2013 | Leonhard |
| 8,487,759 | B2 | 7/2013 | Hill |
| 8,493,757 | B2 | 7/2013 | Carletti et al. |
| 8,505,597 | B2 | 8/2013 | Sharperson |
| 8,506,370 | B2 | 8/2013 | Homsi |
| 8,506,459 | B2 | 8/2013 | Cassidy et al. |
| 8,512,209 | B2 | 8/2013 | Guidi et al. |
| 8,512,210 | B2 | 8/2013 | Shauli |
| 8,516,723 | B2 | 8/2013 | Ferrigan et al. |
| 8,527,101 | B2 | 9/2013 | Burris et al. |
| 8,533,620 | B2 | 9/2013 | Hoffman et al. |
| 8,535,247 | B2 | 9/2013 | Williams |
| 8,537,017 | B2 | 9/2013 | Mack et al. |
| 8,540,560 | B2 | 9/2013 | Crowley et al. |
| 8,540,607 | B2 | 9/2013 | Kissel et al. |
| 8,550,962 | B2 | 10/2013 | Piaget et al. |
| 8,552,859 | B2 | 10/2013 | Pakula et al. |
| 8,556,090 | B2 | 10/2013 | Chen |
| 8,562,489 | B2 | 10/2013 | Burton et al. |
| 8,564,235 | B2 | 10/2013 | Burris et al. |
| 8,569,963 | B2 | 10/2013 | Walters |
| 8,571,250 | B2 | 10/2013 | Royer |
| 8,573,982 | B1 | 11/2013 | Chuang |
| 8,574,131 | B2 | 11/2013 | Daly |
| 8,585,561 | B2 | 11/2013 | Watt et al. |
| 8,602,951 | B2 | 12/2013 | Morris |
| 8,608,624 | B2 | 12/2013 | Shabodyash et al. |
| 8,614,595 | B2 | 12/2013 | Acatrinei |
| 8,614,902 | B2 | 12/2013 | Pansier et al. |
| 8,615,377 | B1 | 12/2013 | Yuen et al. |
| 8,617,008 | B2 | 12/2013 | Marty et al. |
| 8,622,747 | B2 | 1/2014 | Chu et al. |
| 8,647,240 | B2 | 2/2014 | Heidecke |
| 8,651,030 | B2 | 2/2014 | Coffman |
| 8,655,004 | B2 | 2/2014 | Prest et al. |
| 8,657,724 | B2 | 2/2014 | Yang |
| 8,671,853 | B2 | 3/2014 | Flaherty |
| 8,678,897 | B2 | 3/2014 | Englert et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,706,530 | B2 | 4/2014 | Ohnemus et al. |
| 8,708,870 | B2 | 4/2014 | Nalley |
| 8,714,346 | B2 | 5/2014 | Freitag |
| 8,727,946 | B2 | 5/2014 | Greenhill et al. |
| 8,727,947 | B2 | 5/2014 | Tagliabue |
| 8,734,157 | B1 | 5/2014 | Hummel, III |
| 8,734,301 | B2 | 5/2014 | Remelius |
| 8,734,302 | B2 | 5/2014 | Hsieh |
| 8,738,321 | B2 | 5/2014 | Yuen et al. |
| 8,739,974 | B2 | 6/2014 | TeVault et al. |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,077 | B2 | 6/2014 | Redmond |
| 8,762,101 | B2 | 6/2014 | Yuen et al. |
| 8,764,609 | B1 | 7/2014 | Elahmadie |
| 8,777,820 | B2 | 7/2014 | Lo |
| 8,783,326 | B1 | 7/2014 | Vaninger et al. |
| 8,784,274 | B1 | 7/2014 | Chuang |
| 8,786,575 | B2 | 7/2014 | Miller |
| 8,790,222 | B2 | 7/2014 | Burger |
| 8,801,578 | B2 | 8/2014 | Corbalis et al. |
| 8,801,581 | B2 | 8/2014 | Lai et al. |
| 8,801,582 | B2 | 8/2014 | Huang et al. |
| 8,821,350 | B2 | 9/2014 | Maertz |
| 8,823,314 | B2 | 9/2014 | Lumsden et al. |

(56) References Cited

U.S. PATENT DOCUMENTS

| | | | |
|---|---|---|---|
| 8,824,166 | B2 | 9/2014 | Rohrbach |
| 8,824,697 | B2 | 9/2014 | Christoph |
| 8,825,445 | B2 | 9/2014 | Hoffman et al. |
| 8,837,174 | B2 | 9/2014 | Hosotani |
| 8,839,725 | B2 | 9/2014 | Kooistra |
| 8,840,569 | B2 | 9/2014 | Flaction et al. |
| 8,845,498 | B2 | 9/2014 | Webb |
| 8,847,988 | B2 | 9/2014 | Geisner et al. |
| 8,851,565 | B2 | 10/2014 | Hontz et al. |
| 8,858,409 | B2 | 10/2014 | Trees |
| 8,864,627 | B2 | 10/2014 | Bayerlein et al. |
| 8,876,661 | B2 | 11/2014 | Lu |
| 8,876,668 | B2 | 11/2014 | Hendrickson et al. |
| 8,888,660 | B1 | 11/2014 | Oteman |
| 8,892,999 | B2 | 11/2014 | Nims et al. |
| 8,894,549 | B2 | 11/2014 | Colledge |
| 8,894,551 | B2 | 11/2014 | Kerdjoudj |
| 8,913,409 | B2 | 12/2014 | Hui et al. |
| 8,920,291 | B2 | 12/2014 | Chen et al. |
| 8,922,498 | B2 | 12/2014 | Vesely |
| 8,926,475 | B2 | 1/2015 | Lin et al. |
| 8,926,479 | B2 | 1/2015 | Chen et al. |
| 8,939,831 | B2 | 1/2015 | Dugan |
| 8,956,290 | B2 | 2/2015 | Gilley et al. |
| 8,956,715 | B2 | 2/2015 | Kim |
| 8,961,439 | B2 | 2/2015 | Yang et al. |
| 8,968,163 | B1 | 3/2015 | Vidmar |
| 8,979,709 | B2 | 3/2015 | Toback et al. |
| 8,986,165 | B2 | 3/2015 | Ashby |
| 8,986,807 | B2 | 3/2015 | Rodgers |
| 8,986,808 | B2 | 3/2015 | George |
| 8,990,732 | B2 | 3/2015 | Farrenkopf et al. |
| 8,996,978 | B2 | 3/2015 | Richstein et al. |
| 9,005,085 | B2 | 4/2015 | Astilean |
| 9,008,973 | B2 | 4/2015 | French |
| 9,011,291 | B2 | 4/2015 | Birrell |
| 9,015,952 | B2 | 4/2015 | Magosaki |
| 9,028,368 | B2 | 5/2015 | Ashby et al. |
| 9,033,137 | B2 | 5/2015 | Koppes et al. |
| 9,033,712 | B2 | 5/2015 | Vasin |
| 9,038,218 | B1 | 5/2015 | Heil et al. |
| 9,039,578 | B2 | 5/2015 | Dalebout |
| 9,044,637 | B2 | 6/2015 | Karl |
| 9,050,486 | B2 | 6/2015 | Reed |
| 9,050,491 | B2 | 6/2015 | Gordon et al. |
| 9,050,498 | B2 | 6/2015 | Lu et al. |
| 9,063,026 | B2 | 6/2015 | Nassef |
| 9,072,932 | B2 | 7/2015 | Piaget et al. |
| 9,072,941 | B2 | 7/2015 | Duda et al. |
| 9,081,534 | B2 | 7/2015 | Yuen et al. |
| 9,081,889 | B2 | 7/2015 | Ingrassia et al. |
| 9,083,245 | B2 | 7/2015 | Zhao et al. |
| 9,084,565 | B2 | 7/2015 | Mason et al. |
| 9,084,712 | B2 | 7/2015 | Roerdink et al. |
| 9,089,732 | B2 | 7/2015 | Andon et al. |
| 9,091,008 | B2 | 7/2015 | Mathieu |
| 9,095,740 | B2 | 8/2015 | Wu |
| 9,108,079 | B2 | 8/2015 | Solow et al. |
| 9,108,081 | B2 | 8/2015 | Giannelli et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,132,051 | B2 | 9/2015 | Heil |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,148,077 | B2 | 9/2015 | Henderson |
| 9,162,102 | B1 | 10/2015 | Eder et al. |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,198,622 | B2 | 12/2015 | Kaleal et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,242,139 | B2 | 1/2016 | Holley |
| 9,242,142 | B2 | 1/2016 | Vincent et al. |
| 9,256,711 | B2 | 2/2016 | Horseman |
| 9,257,054 | B2 | 2/2016 | Coza et al. |
| 9,263,967 | B2 | 2/2016 | McCune |
| 9,283,431 | B2 | 3/2016 | Marty |
| 9,289,063 | B2 | 3/2016 | Baugh et al. |
| 9,289,674 | B2 | 3/2016 | Winsper et al. |
| 9,308,415 | B2 | 4/2016 | Crawford et al. |
| 9,311,802 | B1 | 4/2016 | Chin et al. |
| 9,314,666 | B2 | 4/2016 | Canavan et al. |
| 9,317,660 | B2 | 4/2016 | Burich et al. |
| 9,320,457 | B2 | 4/2016 | Flaction et al. |
| 9,330,239 | B2 | 5/2016 | Koduri et al. |
| 9,330,544 | B2 | 5/2016 | Levesque et al. |
| 9,333,388 | B2 | 5/2016 | Lee et al. |
| 9,339,681 | B1 | 5/2016 | Nalley |
| 9,339,683 | B2 | 5/2016 | Dilli et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Flynt et al. |
| 9,369,178 | B2 | 6/2016 | Matsutani |
| 9,370,687 | B2 | 6/2016 | Hao |
| 9,370,691 | B2 | 6/2016 | Nissila et al. |
| 9,378,336 | B2 | 6/2016 | Ohnemus et al. |
| 9,387,387 | B2 | 7/2016 | Dalebout |
| 9,389,718 | B1 | 7/2016 | Letourneur |
| 9,392,941 | B2 | 7/2016 | Powch et al. |
| 9,409,050 | B2 | 8/2016 | Mintz |
| 9,411,940 | B2 | 8/2016 | Burroughs et al. |
| 9,415,257 | B2 | 8/2016 | Habing |
| 9,427,615 | B2 | 8/2016 | Pretz et al. |
| 9,452,315 | B1 | 9/2016 | Murray et al. |
| 9,452,320 | B2 | 9/2016 | Yang |
| 9,455,623 | B2 | 9/2016 | Fan et al. |
| 9,455,784 | B2 | 9/2016 | Cune et al. |
| 9,457,224 | B2 | 10/2016 | Giannelli et al. |
| 9,457,256 | B2 | 10/2016 | Aragones et al. |
| 9,463,349 | B1 | 10/2016 | Chang |
| 9,480,874 | B2 | 11/2016 | Cutler |
| 9,486,658 | B2 | 11/2016 | Alexander |
| 9,498,671 | B1 | 11/2016 | Softky |
| 9,505,241 | B2 | 11/2016 | Cuzin |
| 9,511,254 | B2 | 12/2016 | Netter |
| 9,511,259 | B2 | 12/2016 | Mountain |
| 9,511,864 | B2 | 12/2016 | Simpson |
| 9,521,901 | B2 | 12/2016 | Dalebout |
| 9,539,458 | B1 | 1/2017 | Ross |
| 9,540,071 | B2 | 1/2017 | Jordan et al. |
| 9,540,174 | B2 | 1/2017 | Josserond et al. |
| 9,545,541 | B2 | 1/2017 | Aragones et al. |
| 9,560,917 | B2 | 2/2017 | Roslund, Jr. |
| 9,569,986 | B2 | 2/2017 | Levine et al. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,586,085 | B2 | 3/2017 | Arnold et al. |
| 9,586,090 | B2 | 3/2017 | Watterson et al. |
| 9,604,099 | B2 | 3/2017 | Taylor |
| 9,604,757 | B2 | 3/2017 | Spivack et al. |
| 9,610,475 | B1 | 4/2017 | DeKnock et al. |
| 9,610,506 | B2 | 4/2017 | Dugan |
| 9,623,286 | B1 | 4/2017 | Chen |

(56) References Cited

U.S. PATENT DOCUMENTS 9,642,415 B2 5/2017 Pease et al.
9,665,873 B2 5/2017 Ackland
9,673,904 B2 6/2017 Palanisamy et al.
9,681,313 B2 6/2017 Malach
9,682,306 B2 6/2017 Lin et al.
9,682,307 B2 6/2017 Dalebout
9,694,234 B2 7/2017 Dalebout et al.
9,700,780 B2 7/2017 Riley et al.
9,707,441 B2 7/2017 Yang
9,707,447 B1 7/2017 Lopez Babodilla
9,731,158 B1 8/2017 Lo
9,737,747 B1 8/2017 Walsh et al.
9,737,755 B2 8/2017 Dalebout
9,757,605 B2 9/2017 Olson et al.
9,764,184 B2 9/2017 Kueker et al.
9,776,039 B1 10/2017 Xu
9,782,625 B1 10/2017 Blum et al.
9,795,827 B2 10/2017 Wiener et al.
9,808,673 B2 11/2017 Robinson
9,814,927 B2 11/2017 Forystek
9,814,929 B2 11/2017 Moser
9,814,930 B2 11/2017 Manzke et al.
9,827,458 B2 11/2017 Dalton
9,829,068 B2 11/2017 Marchetti
9,833,658 B2 12/2017 Wiener et al.
9,846,438 B2 12/2017 Rihn et al.
9,849,330 B2 12/2017 Lagree
9,884,222 B2 2/2018 Chen
9,889,334 B2 2/2018 Ashby et al.
9,895,567 B2 2/2018 Lee
9,901,767 B2 2/2018 Kuo
9,901,780 B2 2/2018 DeLuca et al.
9,901,805 B2 2/2018 Hughes, Jr.
9,914,011 B2 3/2018 Downey et al.
9,914,014 B2 3/2018 Lagree et al.
9,937,375 B2 4/2018 Zhu
9,943,719 B2 4/2018 Smith et al.
9,948,349 B2 4/2018 Malach
9,950,209 B2 4/2018 Yim et al.
9,956,450 B2 5/2018 Bayerlein et al.
9,968,821 B2 5/2018 Finlayson et al.
9,968,823 B2 5/2018 Cutler
9,975,003 B2 5/2018 Molins et al.
9,979,182 B2 5/2018 Lin et al.
9,987,513 B2 6/2018 Yim et al.
9,987,517 B1 6/2018 Kuo
9,990,126 B2 6/2018 Chanyontpatanakul
9,993,680 B2 6/2018 Gordon
9,993,711 B2 6/2018 Moya Saez
10,001,730 B1 * 6/2018 Gould, II ..... G03G 15/1615
10,004,940 B2 6/2018 Badarneh
10,004,945 B2 6/2018 Sauter
10,010,169 B2 7/2018 Grotenhuis
10,022,590 B2 7/2018 Foley et al.
10,036,443 B2 7/2018 Galasso et al.
10,039,952 B2 8/2018 Chang
10,039,970 B2 8/2018 Lee et al.
10,046,222 B2 8/2018 Hawkins, III et al.
10,065,070 B2 9/2018 Huang
10,070,816 B2 9/2018 Cowley et al.
10,086,254 B2 10/2018 Watterson
2001/0001303 A1 5/2001 Ohsuga et al.
2001/0008053 A1 7/2001 Belli
2001/0024998 A1 9/2001 Novak
2001/0049470 A1 12/2001 Mault et al.
2001/0051564 A1 12/2001 Iund
2002/0016235 A1 2/2002 Ashby et al.
2002/0019298 A1 2/2002 Eschenbach
2002/0024521 A1 2/2002 Goden
2002/0025888 A1 2/2002 Germanton
2002/0026130 A1 2/2002 West
2002/0039952 A1 4/2002 Clem
2002/0043909 A1 4/2002 Nielsen
2002/0045519 A1 4/2002 Watterson
2002/0055418 A1 5/2002 Pyles et al.
2002/0055419 A1 5/2002 Hinnebusch
2002/0055420 A1 5/2002 Stearns et al.
2002/0055422 A1 5/2002 Airmet
2002/0066735 A1 6/2002 Hewlitt et al.
2002/0077221 A1 6/2002 Dalebout et al.
2002/0094914 A1 7/2002 Maresh et al.
2002/0107058 A1 8/2002 Namba et al.
2002/0115536 A1 8/2002 Hojo
2002/0128127 A1 9/2002 Chen
2002/0142890 A1 10/2002 Ohrt
2002/0147078 A1 10/2002 Wu
2002/0151413 A1 10/2002 Dalebout
2002/0160883 A1 10/2002 Dugan
2002/0171070 A1 11/2002 Shim
2002/0198084 A1 12/2002 Stearns et al.
2003/0032524 A1 2/2003 Lamar et al.
2003/0032535 A1 2/2003 Wang
2003/0045406 A1 3/2003 Stone
2003/0060331 A1 3/2003 Polk
2003/0060344 A1 3/2003 David
2003/0069108 A1 4/2003 Kaiserman et al.
2003/0073545 A1 4/2003 Liu
2003/0078138 A1 4/2003 Toyama
2003/0092532 A1 5/2003 Giannelli et al.
2003/0092540 A1 5/2003 Gillen
2003/0092542 A1 5/2003 Bartholomew et al.
2003/0096675 A1 5/2003 Wang
2003/0097878 A1 5/2003 Farringdon et al.
2003/0104908 A1 6/2003 Tung
2003/0119635 A1 6/2003 Arbuckle
2003/0125165 A1 7/2003 Trevino
2003/0128186 A1 7/2003 Laker
2003/0134714 A1 7/2003 Oishi et al.
2003/0134718 A1 7/2003 Kim
2003/0148853 A1 8/2003 Alessandri
2003/0153434 A1 8/2003 Dalebout
2003/0171189 A1 9/2003 Kaufman
2003/0171190 A1 9/2003 Rice
2003/0176815 A1 9/2003 Baba et al.
2003/0181289 A1 9/2003 Oscar Moavro
2003/0181293 A1 9/2003 Baatz
2003/0183027 A1 10/2003 Koch
2003/0211916 A1 11/2003 Capuano
2003/0222419 A1 12/2003 Geary
2003/0232707 A1 12/2003 Dalebout et al.
2003/0236153 A1 12/2003 Pan et al.
2004/0005958 A1 1/2004 Kamen et al.
2004/0005961 A1 1/2004 Iund
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0029645 A1 2/2004 Chen
2004/0033865 A1 2/2004 Wu
2004/0043871 A1 3/2004 Chang
2004/0043873 A1 3/2004 Wilkinson et al.
2004/0051392 A1 3/2004 Badarneh
2004/0053748 A1 3/2004 Lo et al.
2004/0063549 A1 4/2004 Kuo
2004/0067821 A1 4/2004 Kehrbaum
2004/0067833 A1 4/2004 Talish
2004/0082444 A1 4/2004 Golesh
2004/0092367 A1 5/2004 Corbalis
2004/0097331 A1 5/2004 Zillig
2004/0100484 A1 5/2004 Barrett
2004/0103432 A1 5/2004 Barrett
2004/0114768 A1 6/2004 Luo
2004/0127335 A1 7/2004 Watterson
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang

(56) References Cited

U.S. PATENT DOCUMENTS

2004/0142800 A1 7/2004 Gerschefske
2004/0144626 A1 7/2004 Saeki
2004/0152566 A1 8/2004 Yeh
2004/0155622 A1 8/2004 Mayhew et al.
2004/0160336 A1 8/2004 Hoch
2004/0162189 A1 8/2004 Hickman
2004/0162191 A1 8/2004 Ercanbrack
2004/0163574 A1 8/2004 Schoenbach
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0192514 A1 9/2004 Piaget et al.
2004/0198555 A1 10/2004 Anderson
2004/0198559 A1 10/2004 Grossi
2004/0198571 A1 10/2004 Howell et al.
2004/0214693 A1 10/2004 Piaget et al.
2004/0224740 A1 11/2004 Ball et al.
2004/0224825 A1 11/2004 Giannelli et al.
2004/0224827 A1 11/2004 Ashley
2004/0242378 A1 12/2004 Pan
2004/0242379 A1 12/2004 Juva
2004/0242380 A1 12/2004 Kuivala
2004/0248699 A1 12/2004 Colley
2004/0254020 A1 12/2004 Dragusin
2004/0256524 A1 12/2004 Beck et al.
2004/0259689 A1 12/2004 Wilkins et al.
2004/0266587 A1 12/2004 Miller
2005/0003931 A1 1/2005 Mills et al.
2005/0003933 A1 1/2005 Kau
2005/0008992 A1 1/2005 Westergaard et al.
2005/0009668 A1 1/2005 Savettiere
2005/0023292 A1 2/2005 Market et al.
2005/0032610 A1 2/2005 Nelson
2005/0032611 A1 2/2005 Webber
2005/0037898 A1 2/2005 Chang
2005/0037904 A1 2/2005 Chang
2005/0043145 A1 2/2005 Anderson et al.
2005/0043146 A1 2/2005 Lo et al.
2005/0043155 A1 2/2005 Yannitte
2005/0049117 A1 3/2005 Rodgers
2005/0049121 A1 3/2005 Dalebout
2005/0054492 A1 3/2005 Neff
2005/0064994 A1 3/2005 Matsumoto
2005/0075213 A1 4/2005 Arick
2005/0090770 A1 4/2005 Chen
2005/0096187 A1 5/2005 Hsu
2005/0096189 A1 5/2005 Chen
2005/0107220 A1 5/2005 Wang
2005/0107226 A1 5/2005 Monda
2005/0113158 A1 5/2005 Sterchi et al.
2005/0124471 A1 6/2005 Wilkinson
2005/0129903 A1 6/2005 Carr
2005/0130807 A1 6/2005 Cutler
2005/0131319 A1 6/2005 Der Meer
2005/0132838 A1 6/2005 Lin
2005/0143226 A1 6/2005 Heidecke
2005/0143228 A1 6/2005 Lee
2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0159273 A1 7/2005 Chen
2005/0164838 A1 7/2005 Watterson
2005/0164839 A1 7/2005 Watterson
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0192162 A1 9/2005 Pan
2005/0192163 A1 9/2005 Pan et al.
2005/0196737 A1 9/2005 Mann
2005/0202934 A1 9/2005 Olrik et al.
2005/0209050 A1 9/2005 Bartels
2005/0209051 A1 9/2005 Santomassimo et al.
2005/0209052 A1 9/2005 Ashby
2005/0209056 A1 9/2005 Daly
2005/0209060 A1* 9/2005 Lull ..... A63B 71/0054 482/54
2005/0209061 A1* 9/2005 Crawford ..... A63B 22/0017 482/54
2005/0209062 A1 9/2005 Anderson et al.
2005/0215397 A1 9/2005 Watterson
2005/0227820 A1 10/2005 Dyer et al.
2005/0233861 A1 10/2005 Hickman
2005/0233871 A1 10/2005 Anders
2005/0239600 A1 10/2005 Liang
2005/0239607 A1 10/2005 Chang
2005/0245370 A1 11/2005 Boland
2005/0250622 A1 11/2005 Chang
2005/0266961 A1 12/2005 Shum et al.
2005/0272562 A1 12/2005 Alessandri et al.
2005/0272577 A1 12/2005 Olson
2005/0277520 A1 12/2005 Van Waes
2005/0281963 A1 12/2005 Cook
2005/0283911 A1 12/2005 Roussy
2005/0288155 A1 12/2005 Yang
2006/0003869 A1 1/2006 Huang et al.
2006/0003872 A1 1/2006 Chiles et al.
2006/0004265 A1 1/2006 Pulkkinen et al.
2006/0009332 A1 1/2006 Jones
2006/0019804 A1 1/2006 Young
2006/0035755 A1 2/2006 Dalebout
2006/0035757 A1 2/2006 Flick et al.
2006/0035758 A1 2/2006 Rogozinski
2006/0040797 A1 2/2006 Chang
2006/0040798 A1 2/2006 Weier et al.
2006/0046905 A1 3/2006 Doody, Jr.
2006/0047447 A1 3/2006 Brady et al.
2006/0052220 A1 3/2006 Jackson et al.
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0068978 A1 3/2006 Moon
2006/0075544 A1 4/2006 Kriesel
2006/0079800 A1 4/2006 Martikka et al.
2006/0100069 A1 5/2006 Dibble et al.
2006/0100546 A1 5/2006 Silk
2006/0122035 A1 6/2006 Felix
2006/0122038 A1 6/2006 Chou Lin
2006/0122044 A1 6/2006 Ho
2006/0123814 A1 6/2006 Choi et al.
2006/0128534 A1 6/2006 Roque
2006/0132070 A1 6/2006 Heydt et al.
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0166791 A1 7/2006 Liao
2006/0166799 A1 7/2006 Boland et al.
2006/0172862 A1 8/2006 Badarneh et al.
2006/0189439 A1 8/2006 Baudhuin
2006/0189440 A1 8/2006 Gravagne
2006/0189462 A1 8/2006 Pearson et al.
2006/0194679 A1 8/2006 Hatcher
2006/0199706 A1 9/2006 Wehrell
2006/0205568 A1 9/2006 Huang
2006/0205569 A1 9/2006 Watterson
2006/0205571 A1 9/2006 Krull
2006/0217236 A1 9/2006 Watterson
2006/0217245 A1 9/2006 Golesh et al.
2006/0223680 A1 10/2006 Chang

(56) References Cited

U.S. PATENT DOCUMENTS

2006/0229163 A1 10/2006 Waters
2006/0229170 A1 10/2006 Ozawa et al.
2006/0232147 A1 10/2006 Cheng
2006/0234832 A1 10/2006 Toyama et al.
2006/0240947 A1 10/2006 Qu
2006/0240951 A1 10/2006 Wang
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0252608 A1 11/2006 Kang et al.
2006/0258513 A1 11/2006 Routley
2006/0258515 A1 11/2006 Kang et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2007/0004561 A1 1/2007 Yoo
2007/0004562 A1 1/2007 Pan et al.
2007/0004569 A1 1/2007 Cao
2007/0006489 A1 1/2007 Case, Jr. et al.
2007/0010383 A1 1/2007 Pertegaz-Esteban
2007/0015635 A1 1/2007 Donner
2007/0015636 A1 1/2007 Molter
2007/0027002 A1 2/2007 Clark et al.
2007/0027003 A1 2/2007 Clark
2007/0029717 A1* 2/2007 Mori ..... G03G 15/167
271/8.1
2007/0032353 A1 2/2007 Wilkins et al.
2007/0037667 A1 2/2007 Gordon
2007/0038137 A1 2/2007 Arand et al.
2007/0042868 A1 2/2007 Fisher
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135264 A1 6/2007 Rosenberg
2007/0137331 A1 6/2007 Kachouh
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0149363 A1 6/2007 Wang
2007/0151489 A1 7/2007 Byrne
2007/0155277 A1 7/2007 Amitai et al.
2007/0155495 A1 7/2007 Goo
2007/0161466 A1 7/2007 Oglesby et al.
2007/0161468 A1 7/2007 Yanagisawa et al.
2007/0167292 A1 7/2007 Kuo
2007/0179023 A1 8/2007 Dyer
2007/0184953 A1 8/2007 Luberski et al.
2007/0190508 A1 8/2007 Dalton
2007/0191141 A1 8/2007 Weber
2007/0191190 A1 8/2007 Kuo
2007/0191197 A1 8/2007 Vittone
2007/0197274 A1 8/2007 Dugan
2007/0197345 A1 8/2007 Wallace et al.
2007/0197353 A1 8/2007 Hundley
2007/0197920 A1 8/2007 Adams
2007/0201727 A1 8/2007 Birrell et al.
2007/0204430 A1 9/2007 Chase
2007/0214630 A1 9/2007 Kim
2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225622 A1 9/2007 Huang et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0249467 A1 10/2007 Hong et al.
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0284495 A1 12/2007 Charles
2007/0287601 A1 12/2007 Burck et al.
2007/0296313 A1 12/2007 Wang
2007/0298935 A1 12/2007 Badarneh
2007/0298937 A1 12/2007 Shah
2008/0001772 A1* 1/2008 Saito ..... A63B 22/02
340/679
2008/0001866 A1 1/2008 Martin
2008/0004162 A1 1/2008 Chen
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0039301 A1 2/2008 Halbridge
2008/0046246 A1 2/2008 Goldstein et al.
2008/0051256 A1 2/2008 Ashby et al.
2008/0057889 A1 3/2008 Jan
2008/0058169 A1 3/2008 Fox
2008/0058170 A1 3/2008 Giannascoli et al.
2008/0067302 A1 3/2008 Olivera
2008/0070756 A1 3/2008 Chu
2008/0076637 A1 3/2008 Gilley et al.
2008/0076972 A1 3/2008 Dorogusker et al.
2008/0077619 A1 3/2008 Gilley et al.
2008/0086318 A1 4/2008 Gilley et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0119333 A1 5/2008 Bowser
2008/0132386 A1 6/2008 Helie
2008/0139370 A1 6/2008 Charnitski
2008/0153670 A1 6/2008 Mckirdy
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Dierkens et al.
2008/0188362 A1 8/2008 Chen
2008/0190745 A1 8/2008 Taniguchi et al.
2008/0191864 A1 8/2008 Wolfson

(56) References Cited

U.S. PATENT DOCUMENTS

| | | | |
|---|---|---|---|
| 2008/0200287 | A1 | 8/2008 | Marty et al. |
| 2008/0200310 | A1 | 8/2008 | Tagliabue |
| 2008/0200314 | A1 | 8/2008 | Dalebout et al. |
| 2008/0207407 | A1 | 8/2008 | Yeh |
| 2008/0214358 | A1 | 9/2008 | Ogg et al. |
| 2008/0214971 | A1 | 9/2008 | Talish |
| 2008/0216717 | A1 | 9/2008 | Jones |
| 2008/0228110 | A1 | 9/2008 | Berme |
| 2008/0229875 | A1 | 9/2008 | Ray |
| 2008/0234110 | A1 | 9/2008 | Webber et al. |
| 2008/0234111 | A1 | 9/2008 | Packham |
| 2008/0242511 | A1 | 10/2008 | Munoz et al. |
| 2008/0244870 | A1 | 10/2008 | Chase |
| 2008/0245944 | A1 | 10/2008 | Chase |
| 2008/0248926 | A1 | 10/2008 | Cole et al. |
| 2008/0248935 | A1 | 10/2008 | Solow |
| 2008/0250729 | A1 | 10/2008 | Kriesel |
| 2008/0255794 | A1 | 10/2008 | Levine |
| 2008/0269017 | A1 | 10/2008 | Ungari |
| 2008/0279896 | A1 | 11/2008 | Heinen et al. |
| 2008/0280732 | A1 | 11/2008 | Jones |
| 2008/0280733 | A1 | 11/2008 | Dickie et al. |
| 2008/0280734 | A1 | 11/2008 | Dickie et al. |
| 2008/0280735 | A1 | 11/2008 | Dickie et al. |
| 2008/0287262 | A1 | 11/2008 | Chou |
| 2008/0300110 | A1 | 12/2008 | Smith et al. |
| 2008/0300114 | A1 | 12/2008 | Dalebout |
| 2008/0300115 | A1 | 12/2008 | Erlandson |
| 2008/0300116 | A1 | 12/2008 | Eder |
| 2008/0300914 | A1 | 12/2008 | Karkanias et al. |
| 2008/0305936 | A1 | 12/2008 | Cao |
| 2008/0312047 | A1 | 12/2008 | Feng |
| 2008/0318737 | A1 | 12/2008 | Chu |
| 2009/0001831 | A1 | 1/2009 | Cho et al. |
| 2009/0005224 | A1 | 1/2009 | Davis et al. |
| 2009/0011907 | A1 | 1/2009 | Radow |
| 2009/0023553 | A1 | 1/2009 | Shim |
| 2009/0023556 | A1 | 1/2009 | Daly |
| 2009/0027925 | A1 | 1/2009 | Kanouda et al. |
| 2009/0029831 | A1 | 1/2009 | Weier |
| 2009/0036276 | A1 | 2/2009 | Loach |
| 2009/0042696 | A1 | 2/2009 | Wang |
| 2009/0042698 | A1 | 2/2009 | Wang |
| 2009/0047645 | A1 | 2/2009 | Dibenedetto et al. |
| 2009/0048044 | A1 | 2/2009 | Oleson et al. |
| 2009/0048073 | A1 | 2/2009 | Roimicher |
| 2009/0048079 | A1 | 2/2009 | Nalley |
| 2009/0048493 | A1 | 2/2009 | James et al. |
| 2009/0053682 | A1 | 2/2009 | Stern |
| 2009/0054214 | A1 | 2/2009 | Kadar |
| 2009/0054751 | A1 | 2/2009 | Babashan et al. |
| 2009/0062072 | A1 | 3/2009 | Packham |
| 2009/0069159 | A1 | 3/2009 | Wang |
| 2009/0069722 | A1 | 3/2009 | Flaction et al. |
| 2009/0075781 | A1 | 3/2009 | Schwarzberg et al. |
| 2009/0075784 | A1 | 3/2009 | Hoggan |
| 2009/0080808 | A1 | 3/2009 | Hagen |
| 2009/0082176 | A1 | 3/2009 | Watterson et al. |
| 2009/0088301 | A1 | 4/2009 | Alling |
| 2009/0093347 | A1 | 4/2009 | Wang |
| 2009/0100718 | A1 | 4/2009 | Gerber |
| 2009/0105047 | A1 | 4/2009 | Guidi |
| 2009/0105052 | A1 | 4/2009 | Dalebout et al. |
| 2009/0105548 | A1 | 4/2009 | Bart |
| 2009/0111664 | A1 | 4/2009 | Kau |
| 2009/0111665 | A1 | 4/2009 | Wang |
| 2009/0111666 | A1 | 4/2009 | Wang |
| 2009/0111670 | A1 | 4/2009 | Williams |
| 2009/0118098 | A1 | 5/2009 | Yeh |
| 2009/0118103 | A1 | 5/2009 | Ellis |
| 2009/0119032 | A1 | 5/2009 | Meyer |
| 2009/0120208 | A1 | 5/2009 | Meyer |
| 2009/0120210 | A1 | 5/2009 | Phillips et al. |
| 2009/0124463 | A1 | 5/2009 | Chen |
| 2009/0124464 | A1 | 5/2009 | Kastelic |
| 2009/0124465 | A1 | 5/2009 | Wang |
| 2009/0124466 | A1 | 5/2009 | Zhang |
| 2009/0128516 | A1 | 5/2009 | Rimon et al. |
| 2009/0131225 | A1 | 5/2009 | Burdea |
| 2009/0137367 | A1 | 5/2009 | Hendrickson et al. |
| 2009/0144639 | A1 | 6/2009 | Nims et al. |
| 2009/0156363 | A1 | 6/2009 | Guidi et al. |
| 2009/0156364 | A1 | 6/2009 | Simeoni |
| 2009/0158871 | A1 | 6/2009 | Chuo |
| 2009/0163326 | A1 | 6/2009 | Wang |
| 2009/0163327 | A1 | 6/2009 | Huang et al. |
| 2009/0163334 | A1 | 6/2009 | Gibson et al. |
| 2009/0170663 | A1 | 7/2009 | Cox et al. |
| 2009/0170667 | A1 | 7/2009 | Irving et al. |
| 2009/0170672 | A1 | 7/2009 | Mcmullen |
| 2009/0176625 | A1 | 7/2009 | Giannelli et al. |
| 2009/0176628 | A1 | 7/2009 | Radding et al. |
| 2009/0180646 | A1 | 7/2009 | Vulfson et al. |
| 2009/0181829 | A1 | 7/2009 | Wu |
| 2009/0181830 | A1 | 7/2009 | Wu |
| 2009/0181831 | A1 | 7/2009 | Kuo |
| 2009/0181833 | A1 | 7/2009 | Cassidy |
| 2009/0197740 | A1 | 8/2009 | Julskjaer et al. |
| 2009/0209393 | A1 | 8/2009 | Crater et al. |
| 2009/0221405 | A1 | 9/2009 | Wang |
| 2009/0221407 | A1 | 9/2009 | Hauk |
| 2009/0227424 | A1 | 9/2009 | Hirata et al. |
| 2009/0227432 | A1 | 9/2009 | Pacheco |
| 2009/0232420 | A1 | 9/2009 | Eisenberg et al. |
| 2009/0240858 | A1 | 9/2009 | Takebayashi |
| 2009/0246746 | A1 | 10/2009 | Roerdink et al. |
| 2009/0253554 | A1 | 10/2009 | Mcintosh |
| 2009/0258710 | A1 | 10/2009 | Quatrochi et al. |
| 2009/0258763 | A1 | 10/2009 | Richter |
| 2009/0264258 | A1 | 10/2009 | Lo |
| 2009/0264260 | A1 | 10/2009 | Piaget et al. |
| 2009/0269728 | A1 | 10/2009 | Verstegen et al. |
| 2009/0280964 | A1 | 11/2009 | Chen |
| 2009/0286653 | A1 | 11/2009 | Wiber |
| 2009/0293319 | A1 | 12/2009 | Avni |
| 2009/0298649 | A1 | 12/2009 | Dyer et al. |
| 2009/0312158 | A1 | 12/2009 | Trevino et al. |
| 2010/0015585 | A1 | 1/2010 | Baker |
| 2010/0016127 | A1 | 1/2010 | Farnsworth et al. |
| 2010/0022354 | A1 | 1/2010 | Fisher |
| 2010/0024590 | A1 | 2/2010 | O'neill |
| 2010/0032533 | A1 | 2/2010 | Chen et al. |
| 2010/0034665 | A1 | 2/2010 | Zhong et al. |
| 2010/0035726 | A1 | 2/2010 | Fisher et al. |
| 2010/0041516 | A1 | 2/2010 | Kodama |
| 2010/0048358 | A1 | 2/2010 | Tchao et al. |
| 2010/0062904 | A1 | 3/2010 | Crawford et al. |
| 2010/0062914 | A1 | 3/2010 | Splane |
| 2010/0063426 | A1 | 3/2010 | Planke |
| 2010/0064255 | A1 | 3/2010 | Rottler et al. |
| 2010/0069202 | A1 | 3/2010 | Olsen |
| 2010/0075812 | A1 | 3/2010 | Piaget et al. |
| 2010/0079291 | A1 | 4/2010 | Kroll et al. |
| 2010/0081548 | A1 | 4/2010 | Labedz |
| 2010/0087298 | A1 | 4/2010 | Zaccherini |
| 2010/0093492 | A1 | 4/2010 | Watterson et al. |
| 2010/0099541 | A1 | 4/2010 | Patel |
| 2010/0105527 | A1 | 4/2010 | Johnson |
| 2010/0113223 | A1 | 5/2010 | Chiles et al. |
| 2010/0125026 | A1 | 5/2010 | Zavadsky et al. |
| 2010/0130337 | A1 | 5/2010 | Stewart |
| 2010/0137105 | A1 | 6/2010 | McLaughlin |
| 2010/0144501 | A1 | 6/2010 | Berhanu |
| 2010/0156625 | A1 | 6/2010 | Ruha |
| 2010/0164579 | A1 | 7/2010 | Acatrinei |
| 2010/0167883 | A1 | 7/2010 | Grind |
| 2010/0173276 | A1 | 7/2010 | Vasin |
| 2010/0173755 | A1 | 7/2010 | P Erez De Lazarraga |
| 2010/0175634 | A1 | 7/2010 | Chang et al. |
| 2010/0184568 | A1 | 7/2010 | Schippers |
| 2010/0190615 | A1 | 7/2010 | Baker et al. |
| 2010/0192715 | A1 | 8/2010 | Vauchel et al. |
| 2010/0197462 | A1 | 8/2010 | Piane, Jr. |
| 2010/0197465 | A1 | 8/2010 | Stevenson |

(56) References Cited

U.S. PATENT DOCUMENTS

2010/0210418 A1 8/2010 Park
2010/0216599 A1 8/2010 Watterson
2010/0216600 A1 8/2010 Noffsinger
2010/0216607 A1 8/2010 Mueller
2010/0222179 A1 9/2010 Temple et al.
2010/0222182 A1 9/2010 Park
2010/0227740 A1 9/2010 Liu
2010/0234185 A1 9/2010 Watt et al.
2010/0235667 A1 9/2010 Mucignat et al.
2010/0240458 A1 9/2010 Gaiba et al.
2010/0248899 A1 9/2010 Bedell et al.
2010/0248900 A1 9/2010 Ashby
2010/0255959 A1 10/2010 Dalebout et al.
2010/0267524 A1 10/2010 Stewart et al.
2010/0279822 A1 11/2010 Ford
2010/0285933 A1 11/2010 Nalley
2010/0289466 A1 11/2010 Telefus
2010/0289772 A1 11/2010 Miller
2010/0292050 A1 11/2010 DiBenedetto et al.
2010/0292600 A1 11/2010 Dibenedetto et al.
2010/0303513 A1* 12/2010 Nakagaki ..... G03G 15/161 399/301
2010/0304931 A1 12/2010 Stumpf
2010/0304932 A1 12/2010 Kolman et al.
2010/0311552 A1 12/2010 Sumners
2010/0320956 A1 12/2010 Lumsden et al.
2011/0003664 A1 1/2011 Richard
2011/0009249 A1 1/2011 Campanaro et al.
2011/0021319 A1 1/2011 Nissila et al.
2011/0021323 A1 1/2011 Wu
2011/0028282 A1 2/2011 Sbragia
2011/0034300 A1 2/2011 Hall
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0065504 A1 3/2011 Dugan et al.
2011/0067361 A1 3/2011 Sloan
2011/0073743 A1 3/2011 Shamie
2011/0075835 A1 3/2011 Hill
2011/0077055 A1 3/2011 Pakula et al.
2011/0082011 A1 4/2011 Ellis
2011/0082013 A1 4/2011 Bastian
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0112771 A1 5/2011 French
2011/0118089 A1 5/2011 Ellis
2011/0118090 A1 5/2011 Ellis
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143898 A1 6/2011 Trees
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0165995 A1 7/2011 Paulus
2011/0172060 A1 7/2011 Morales et al.
2011/0175744 A1 7/2011 Englert et al.
2011/0181420 A1 7/2011 Mack et al.
2011/0188269 A1 8/2011 Hosotani
2011/0197157 A1 8/2011 Hoffman et al.
2011/0199799 A1 8/2011 Hui et al.
2011/0201481 A1 8/2011 Lo
2011/0202236 A1 8/2011 Galasso et al.
2011/0205164 A1 8/2011 Hansen et al.
2011/0221672 A1 9/2011 Osterhout et al.
2011/0237396 A1 9/2011 Lu
2011/0237399 A1 9/2011 Toback
2011/0247530 A1 10/2011 Coffman
2011/0251021 A1 10/2011 Zavadsky et al.
2011/0252597 A1 10/2011 Burris et al.
2011/0256988 A1 10/2011 Weier
2011/0257797 A1 10/2011 Burris et al.
2011/0263384 A1 10/2011 Drazan
2011/0269517 A1 11/2011 Englert et al.
2011/0269604 A1 11/2011 Tseng
2011/0275482 A1 11/2011 Brodess et al.
2011/0275489 A1 11/2011 Apau
2011/0275499 A1 11/2011 Eschenbach
2011/0281691 A1 11/2011 Ellis
2011/0283188 A1 11/2011 Farrenkopf et al.
2011/0283231 A1 11/2011 Richstein et al.
2011/0308919 A1 12/2011 Hahn
2011/0312473 A1 12/2011 Chu et al.
2011/0319229 A1 12/2011 Corbalis et al.
2012/0004075 A1 1/2012 Kissel et al.
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0020135 A1 1/2012 McCune
2012/0021873 A1 1/2012 Brunner
2012/0021875 A1 1/2012 Karl
2012/0029666 A1 2/2012 Crowley et al.
2012/0032896 A1 2/2012 Vesely
2012/0046144 A1 2/2012 Lin et al.
2012/0071301 A1 3/2012 Kaylor et al.
2012/0088633 A1 4/2012 Crafton
2012/0088634 A1 4/2012 Heidecke
2012/0088640 A1 4/2012 Wissink
2012/0116684 A1 5/2012 Ingrassia et al.
2012/0132877 A1 5/2012 Wang
2012/0133192 A1 5/2012 Simpson
2012/0157267 A1* 6/2012 Lo ..... A63B 22/02 482/54
2012/0165162 A1 6/2012 Lu
2012/0169603 A1 7/2012 Peterson et al.
2012/0174833 A1 7/2012 Early
2012/0178590 A1 7/2012 Lu
2012/0178591 A1 7/2012 Remelius
2012/0187012 A1 7/2012 TeVault et al.
2012/0190502 A1 7/2012 Paulus et al.
2012/0212505 A1 8/2012 Burroughs et al.
2012/0218184 A1 8/2012 Wissmar
2012/0230504 A1 9/2012 Kuroda
2012/0231934 A1* 9/2012 Lo ..... A63B 22/02 482/54
2012/0242774 A1 9/2012 Numano et al.
2012/0248263 A1 10/2012 Grotenhuis
2012/0252580 A1 10/2012 Dugan
2012/0253234 A1 10/2012 Yang et al.
2012/0253489 A1 10/2012 Dugan
2012/0258433 A1 10/2012 Hope et al.
2012/0263892 A1 10/2012 Rodgers
2012/0270705 A1 10/2012 Lo
2012/0271143 A1 10/2012 Aragones et al.
2012/0277040 A1 11/2012 Vincent et al.
2012/0277891 A1 11/2012 Aragones et al.
2012/0293141 A1 11/2012 Zhang et al.
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0319604 A1 12/2012 Walters
2012/0326873 A1 12/2012 Utter, II
2013/0002533 A1 1/2013 Burroughs et al.
2013/0004010 A1 1/2013 Royer
2013/0009993 A1 1/2013 Horseman
2013/0017929 A1 1/2013 Hendrickson et al.
2013/0018494 A1 1/2013 Amini
2013/0034671 A1 2/2013 George
2013/0035612 A1 2/2013 Mason et al.
2013/0040783 A1 2/2013 Duda et al.

(56) References Cited

U.S. PATENT DOCUMENTS

2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053222 A1 2/2013 Lo
2013/0053990 A1 2/2013 Ackland
2013/0092647 A1 4/2013 Chen
2013/0095959 A1 4/2013 Marty
2013/0095978 A1 4/2013 Sauter
2013/0116095 A1 5/2013 Hsieh
2013/0123073 A1 5/2013 Olson et al.
2013/0130868 A1 5/2013 Hou
2013/0130869 A1 5/2013 Hou
2013/0139736 A1 6/2013 Flaherty
2013/0141235 A1 6/2013 Utter, II
2013/0143721 A1 6/2013 Dalebout
2013/0147411 A1 6/2013 Pang et al.
2013/0150214 A1 6/2013 Wu
2013/0154441 A1 6/2013 Redmond
2013/0165297 A1 6/2013 Daly
2013/0172152 A1 7/2013 Watterson
2013/0182781 A1 7/2013 Matsutani
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0196821 A1 8/2013 Watterson et al.
2013/0196826 A1 8/2013 Colledge
2013/0196827 A1 8/2013 Chang
2013/0203561 A1 8/2013 Lee et al.
2013/0211858 A1 8/2013 Ohnemus et al.
2013/0228063 A1 9/2013 Turner
2013/0228422 A1 9/2013 Mathieu
2013/0231219 A1 9/2013 Huang
2013/0237383 A1 9/2013 Chen
2013/0245966 A1 9/2013 Burroughs et al.
2013/0263418 A1 10/2013 Johnson, Jr.
2013/0267386 A1 10/2013 Her
2013/0274040 A1 10/2013 Coza et al.
2013/0274069 A1 10/2013 Watterson et al.
2013/0274071 A1 10/2013 Wang
2013/0280682 A1 10/2013 Levine et al.
2013/0324368 A1 12/2013 Aragones et al.
2013/0325394 A1 12/2013 Yuen et al.
2013/0337981 A1 12/2013 Habing
2013/0338802 A1 12/2013 Winsper et al.
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0039840 A1 2/2014 Yuen et al.
2014/0052280 A1 2/2014 Yuen et al.
2014/0056461 A1 2/2014 Afshar
2014/0073488 A1 3/2014 Wu
2014/0077494 A1 3/2014 Sutkowski
2014/0080678 A1 3/2014 Wu
2014/0085077 A1 3/2014 Luna et al.
2014/0100464 A1 4/2014 Kaleal et al.
2014/0102340 A1 4/2014 Kooistra
2014/0121066 A1 5/2014 Huang et al.
2014/0139450 A1 5/2014 Levesque et al.
2014/0156228 A1 6/2014 Molettiere et al.
2014/0171266 A1 6/2014 Hawkins, III et al.
2014/0187383 A1 7/2014 Martin
2014/0195103 A1 7/2014 Nassef
2014/0221160 A1 8/2014 Hardy et al.
2014/0222173 A1 8/2014 Giedwoyn et al.
2014/0265690 A1 9/2014 Henderson
2014/0270375 A1 9/2014 Canavan et al.
2014/0274564 A1 9/2014 Greenbaum
2014/0274579 A1 9/2014 Olson
2014/0338120 A1 11/2014 Baugh et al.
2014/0358473 A1 12/2014 Goel et al.
2014/0360413 A1 12/2014 Schenk
2015/0001048 A1 1/2015 Koppes et al.
2015/0003621 A1 1/2015 Trammell
2015/0004579 A1 1/2015 Shelton
2015/0016623 A1 1/2015 Trammell
2015/0044648 A1 2/2015 White et al.
2015/0048807 A1 2/2015 Fan et al.
2015/0051051 A1 2/2015 Liu et al.
2015/0065273 A1 3/2015 Lake
2015/0065301 A1 3/2015 Oteman
2015/0105220 A1 4/2015 Hong
2015/0182782 A1 7/2015 Cutler
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0246751 A1 9/2015 Spivack et al.
2015/0250304 A1 9/2015 Dalebout
2015/0251047 A1 9/2015 Maaniitty
2015/0251048 A1 9/2015 Dalebout
2015/0251055 A1 9/2015 Ashby
2015/0253210 A1 9/2015 Ashby et al.
2015/0265903 A1 9/2015 Kolen et al.
2015/0295397 A1 10/2015 Lin et al.
2015/0314184 A1 11/2015 Moya Saez
2015/0321337 A1* 11/2015 Stephens, Jr. ..... B25J 3/00 700/257
2015/0335941 A1 11/2015 Lo
2015/0346994 A1 12/2015 Chanyontpatanakul
2015/0352396 A1 12/2015 Dalebout
2015/0352401 A1 12/2015 Johnson
2015/0352402 A1 12/2015 Arnold et al.
2015/0367158 A1 12/2015 Pretz et al.
2015/0367176 A1 12/2015 Bejestan et al.
2016/0008650 A1 1/2016 Jue et al.
2016/0016035 A1 1/2016 Hao
2016/0027325 A1 1/2016 Malhotra
2016/0038785 A1 2/2016 Netter
2016/0047446 A1 2/2016 Hung
2016/0066818 A1 3/2016 Cowley et al.
2016/0074701 A1 3/2016 Wiener
2016/0074705 A1 3/2016 Wiener
2016/0096064 A1 4/2016 Gatti
2016/0175643 A1 6/2016 Kueker et al.
2016/0184625 A1 6/2016 Chang
2016/0193518 A1 7/2016 Baxter
2016/0211841 A1 7/2016 Harrison
2016/0219968 A1 8/2016 Martin
2016/0263426 A1 9/2016 Mueller et al.
2016/0287930 A1 10/2016 Moser
2016/0303421 A1 10/2016 Tyger et al.
2016/0317861 A1 11/2016 Dalebout
2016/0367851 A1 12/2016 Astilean et al.
2017/0056716 A1 3/2017 Cutler
2017/0056726 A1 3/2017 Dalebout et al.
2017/0065851 A1 3/2017 Deluca et al.
2017/0068782 A1 3/2017 Pillai et al.
2017/0087417 A1* 3/2017 Peavy ..... A63B 21/0085
2017/0113093 A1 4/2017 Bellavista et al.
2017/0120102 A1 5/2017 Chen
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136339 A1 5/2017 Habiche
2017/0165523 A1 6/2017 Chou
2017/0189745 A1 7/2017 Hamilton et al.
2017/0216660 A1 8/2017 Lernihan
2017/0266483 A1 9/2017 Dalebout et al.
2017/0266532 A1 9/2017 Watterson
2017/0266533 A1 9/2017 Dalebout
2017/0266534 A1 9/2017 Watterson
2017/0266535 A1 9/2017 Watterson
2017/0274242 A1 9/2017 Corbalis
2017/0326411 A1 11/2017 Watterson
2017/0340917 A1 11/2017 Chang
2017/0368442 A1 12/2017 Baudhuin
2018/0001135 A1 1/2018 Powell

(56) References Cited

U.S. PATENT DOCUMENTS

| | | | |
|---|---|---|---|
| 2018/0036585 | A1 | 2/2018 | Powell |
| 2018/0056111 | A1 | 3/2018 | Chiang et al. |
| 2018/0092603 | A1 | 4/2018 | Duan et al. |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0104533 | A1 | 4/2018 | Powell et al. |
| 2018/0111018 | A1 | 4/2018 | Lee |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0147440 | A1 | 5/2018 | Lin |
| 2018/0154205 | A1 | 6/2018 | Watterson |
| 2018/0154208 | A1 | 6/2018 | Powell et al. |

OTHER PUBLICATIONS

International Search Report for PCT/US2018/066061, dated Apr. 17, 2019, 3 pages.

* cited by examiner

SECTION A-A

AUDIBLE BELT GUIDE IN A TREADMILL

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

In some cases, the conveyor belt may move slightly out of its desired position during the normal course of use of the treadmill such that it may rub against some portion of the treadmill. This unintended rubbing may go unnoticed by a user and may wear out the belt more quickly than if it were in its desired position, leading to a more frequent need to replace the belt and higher maintenance costs for the user.

SUMMARY

In one embodiment, a treadmill includes an exercise deck. The exercise deck includes a platform, at least one pulley attached to the platform, a sliding surface of the platform, a tread belt riding portion of the sliding surface, a tread belt surrounding the at least one pulley and the sliding surface, the tread belt having at least one side edge, and a belt guide incorporated into the platform. The belt guide includes a textured portion of the sliding surface aligned with the at least one of side edge of the tread belt and spaced apart therefrom when the tread belt is positioned entirely within the tread belt riding portion. When the textured portion comes into contact with the tread belt, due to the tread belt being misaligned, the tread belt and the textured portion interact to collectively produce a misalignment sound audible to a user, providing an audible indicator of tread belt misalignment The textured portion may include a plurality of protrusions.

The textured portion may include a plurality of ribs.

The plurality of ribs may be arranged perpendicular to the at least one edge of the tread belt.

The textured portion may include a rough surface having a root mean square surface roughness of more than about 5 microns.

The textured portion may include a patterned surface.

The belt guide may include a lip portion extending over at least a portion of the at least one edge of the tread belt.

The textured portion may be positioned above the at least one edge of the tread belt.

The tread belt and the tread belt riding portion may collectively produce an operational sound audible to a user when the tread belt is in motion with respect to the sliding surface when the tread belt is not in contact with the textured portion. The operating sound may produce a different frequency than the misalignment sound.

The belt guide may include a raised ledge aligned with the at least one edge of the tread belt.

The textured portion may contact the at least one edge of the tread belt to mechanically produce the misalignment sound when the tread belt is in motion around the sliding surface and at least a portion of the tread belt is positioned outside the tread belt riding portion.

The textured portion may contact an interior pulley facing surface of the tread belt to mechanically produce the sound audible to the user when the tread belt is in motion around the at least one pulley and at least a portion of the tread belt is positioned outside the tread belt riding portion.

The misalignment sound may not be produced when no portion of the tread belt is positioned outside the tread belt riding portion.

The misalignment sound may be distinguishable by a user from routine operating sounds of the treadmill produced when the tread belt is entirely positioned within the tread belt riding portion.

In one embodiment, a treadmill includes an exercise deck. The exercise deck includes a platform, at least one pulley attached to the platform, a sliding surface of the platform, a tread belt riding portion defined in the sliding surface, a tread belt surrounding the at least one pulley where the tread belt has at least one edge, and a belt guide incorporated into the platform. The belt guide may include a textured portion aligned with the at least one edge of the tread belt and spaced apart therefrom when the tread belt is positioned within the tread belt riding portion. The textured portion contacts a portion of the tread belt mechanically producing a misalignment sound audible when the tread belt is in motion with respect to the sliding surface and at least a portion of the tread belt is positioned outside the tread belt riding portion. The misalignment sound may not be produced when the tread belt is positioned entirely within the tread belt riding portion and the misalignment sound is distinguishable from a routine operating sound of the treadmill.

The belt guide may include a lip portion extending over at least a portion of the at least one edge of the tread belt.

The textured portion may be positioned above the at least one edge of the tread belt.

The belt guide may include a raised ledge aligned with the at least one edge of the tread belt.

The textured surface may engage an underside surface of the tread belt when the tread belt is misaligned out of the tread belt riding portion.

In one embodiment, a treadmill includes an exercise deck. The exercise deck includes a platform, a first pulley attached to the platform in a front portion, a second pulley attached to the platform in a rear portion, a sliding surface of the platform, a tread belt riding portion of the sliding surface, a tread belt surrounding the first pulley, the second pulley, and the sliding surface, the tread belt having at least one edge and a top surface, and a belt guide incorporated into the platform. The belt guide includes a lip portion extending over at least a portion of the at least one edge of the tread belt. A textured portion includes a rough surface, the textured portion aligned with and positioned above the at least one edge of the tread belt and spaced apart therefrom when the tread belt is positioned within the tread belt riding portion. The textured portion contacts the top surface of the tread belt to thereby mechanically produce a misalignment sound audible to a user when the tread belt is in motion with respect to the sliding surface of the platform and at least a portion of the tread belt is positioned outside the tread belt riding portion. The misalignment sound is not produced when the tread belt is positioned entirely within the tread belt riding portion and the misalignment sound is distinguishable by the user from a routine operating sound of the treadmill.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The term "tread belt riding portion" generally refers to a portion of the sliding surface that is intended for the tread belt to slide on. In some cases, the tread belt riding portion includes a smooth surface with relatively low amounts of friction against which the tread belt can slide across. In some cases, the sliding portion is framed with a lip or ledge on either side of the sliding portion, but the "tread belt riding portion" may be narrower than the entire sliding area. In some cases, a textured portion abuts the "tread belt riding portion" on at least one side.

Figure 1:
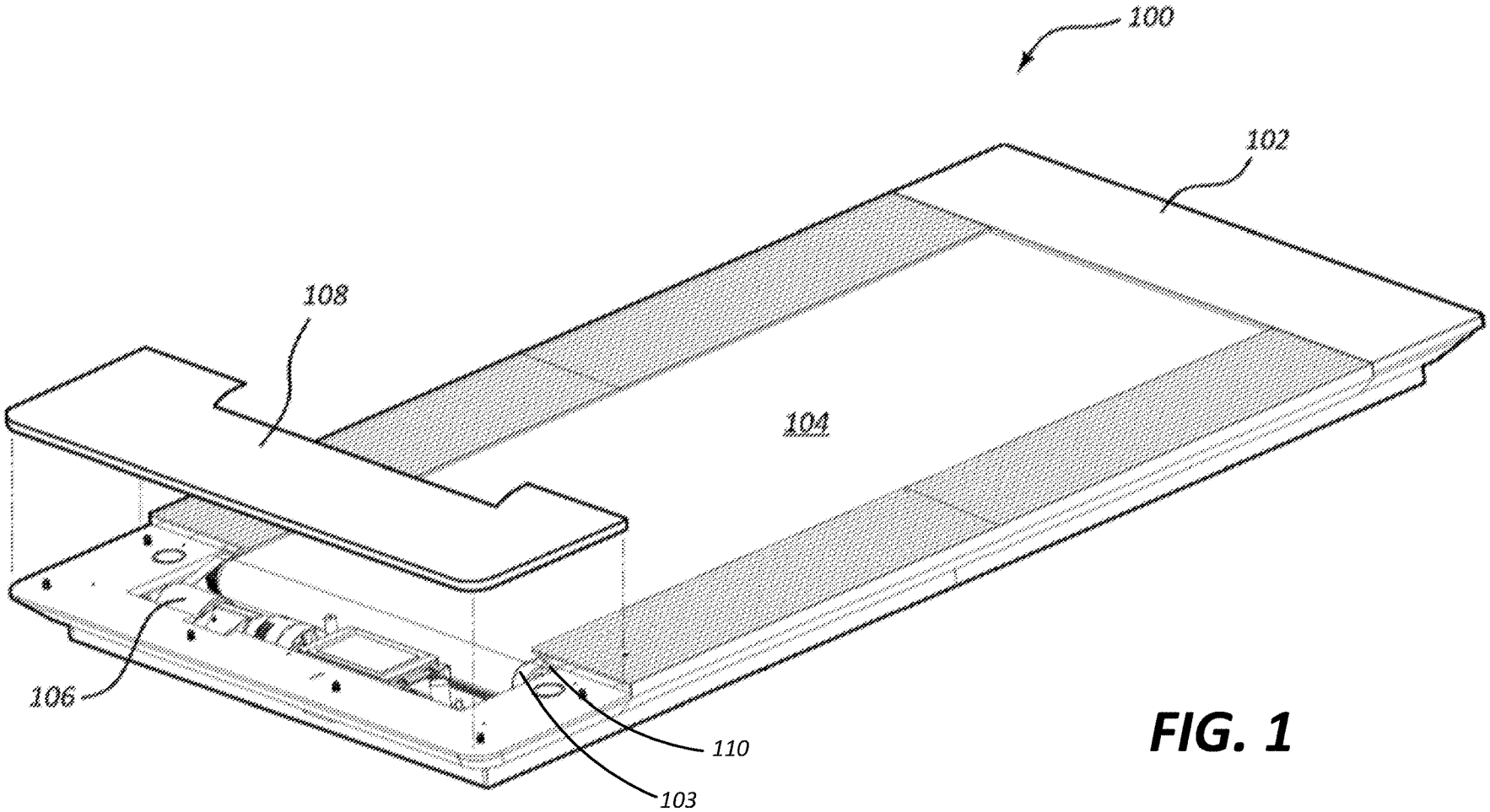
FIG. 1 illustrates a perspective view of an example of a treadmill in accordance with the present disclosure.

FIG. 1 depicts an example of a treadmill 100 having a deck 102 with a first pulley 103 disposed in a first portion of the deck 102 and a second pulley incorporated into a second portion of the deck 102. A tread belt 104 surrounds the first pulley and the second pulley. A motor 106 is in mechanical communication with either the first pulley or the second pulley. A cover 108 is superjacent the motor 106.

The treadmill 100 also includes at least one belt guide 110 that may audibly indicate to a user when the tread belt 104 is off-center, off-canter, or otherwise displaced from a belt riding portion of the first and/or second pulley while in motion. For example, the belt guide 110 may mechanically produce a sound that is audible to a user when the tread belt 104 is off-center or otherwise out of position around the first and/or second pulleys.

Figure 2:
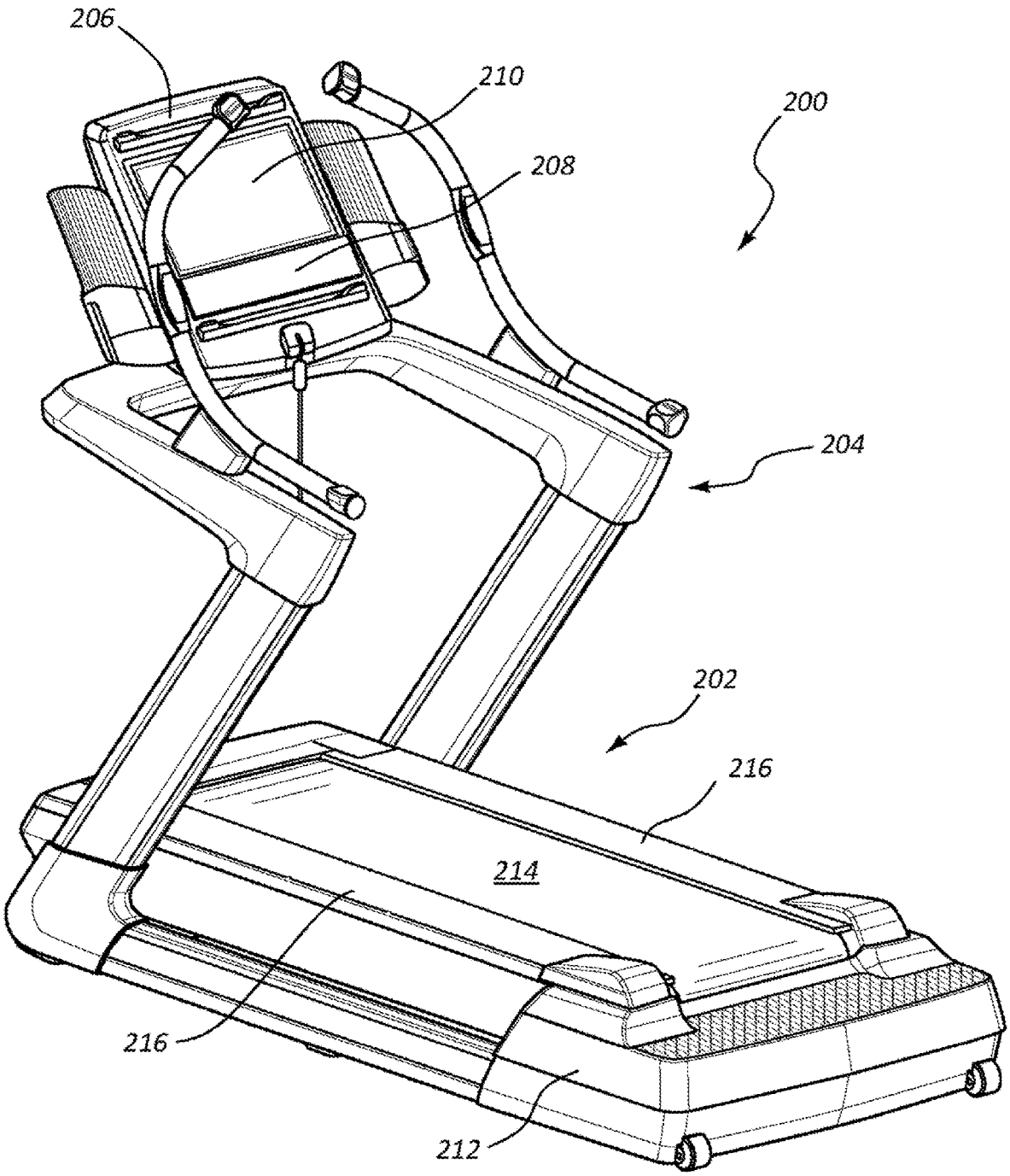
FIG. 2 illustrates a perspective view of an example of a treadmill in accordance with the present disclosure.

FIG. 2 depicts an example of a treadmill 200 that includes a deck 202 and an upright structure 204. The upright structure 204 includes a console 206 and incorporates at least one input mechanism 208 and a display 210. The input mechanism 208 can control at least one parameter of the treadmill, such as the speed of the tread belt 214, the incline of the deck 202, a climate control, entertainment, and so forth.

The deck includes a platform 212 with a front pulley and a rear pulley. A tread belt 214 surrounds the front and rear pulleys. The platform 212 includes portions of the deck 202 that are adjacent to the tread belt's edges. In the example of FIG. 2, these regions may include a belt guide 216 that overlaps with a portion of the tread belt. A textured portion (not shown) may be incorporated into an underside with the belt guide 216 so that when the tread belt 214 is misaligned, the tread belt 214 and the textured portion come into contact with each other.

Figure 3:
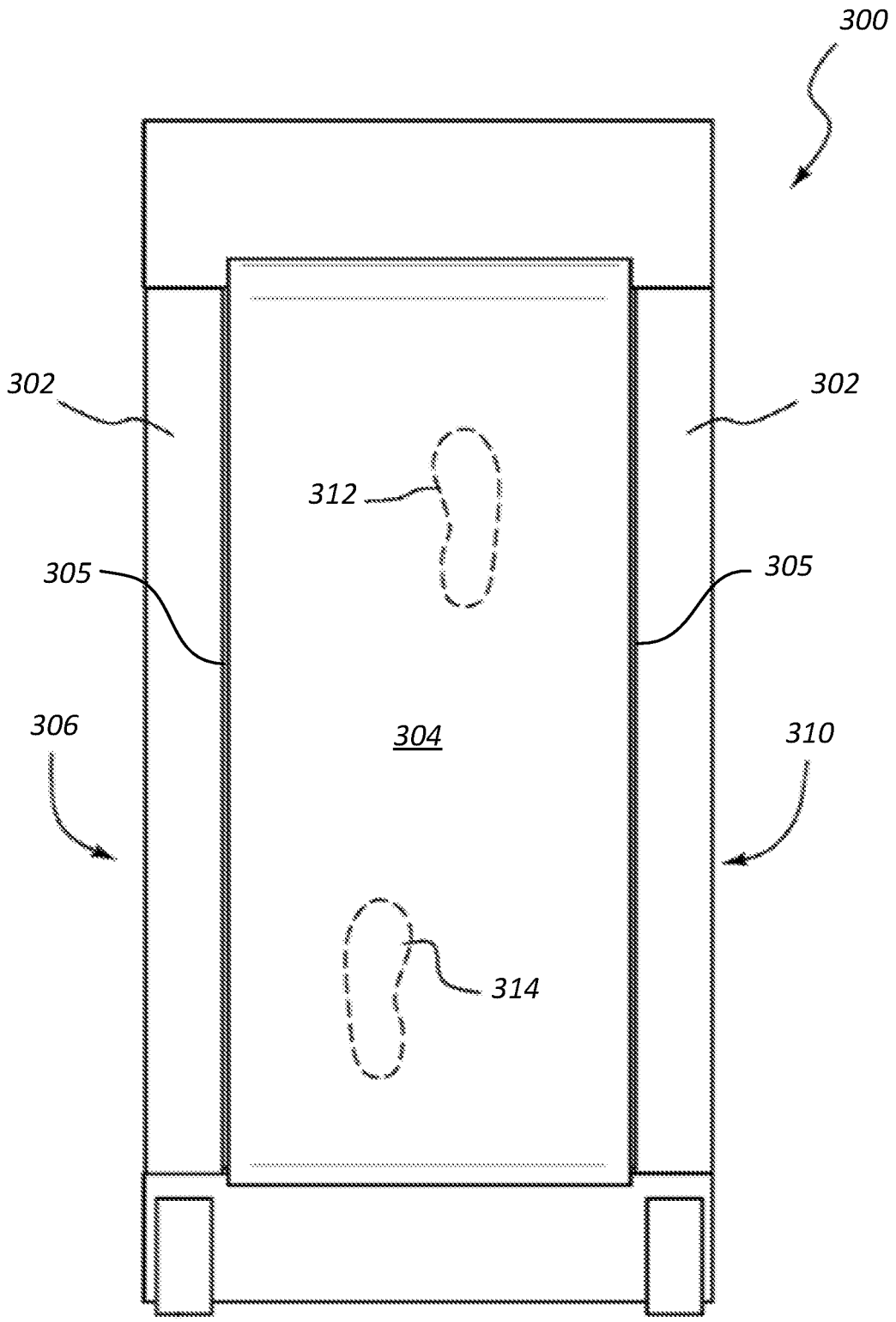
FIG. 3 illustrates a top view of an example of a treadmill in accordance with the present disclosure.

FIG. 3 depicts a top view of an example deck 300 and the belt guides 302 of the platform. As illustrated, in some cases the deck 300 may include a belt guide 302 on the left side 306 and/or the right side 310 of the deck 300. In some cases at least one of the belt guides 302 include a textured portion which may mechanically produce an audible sound when contacted by the tread belt 304 while the tread belt 304 is displaced or otherwise out of position as described herein. In some cases both belt guides 302 on sides 306 and 310 may include a textured portion as described herein. For illustrative purposes, a user's first foot is represented with a first foot print 312 and a user's second foot is represented with a second foot print 314.

In some cases, the textured portion of the belt guide or guides 302 may be positioned at any position along the length of the belt guide 302 and may be aligned with an edge 305 of the tread belt 304. In some cases the textured portion of the belt guide may run an entire length of the belt guide 302. However in some other cases, the textured portion may extend along between about half of the length of the belt guide 302 and the entire length of the belt guide 302. In some cases the textured portion may extend along less than about half of the length of the belt guide 302, for example about ⅓, ¼, ⅛, 1/16, 1/32 or less of the length of the belt guide. In some embodiments the textured portion may not include one continuous portion and may be divided by one or more untextured portions of the belt guide 302. For example, the textured portion may include a first portion located near a first end of the belt guide 302 and a second textured portion located near a second end of the belt guide.

Figure 4:
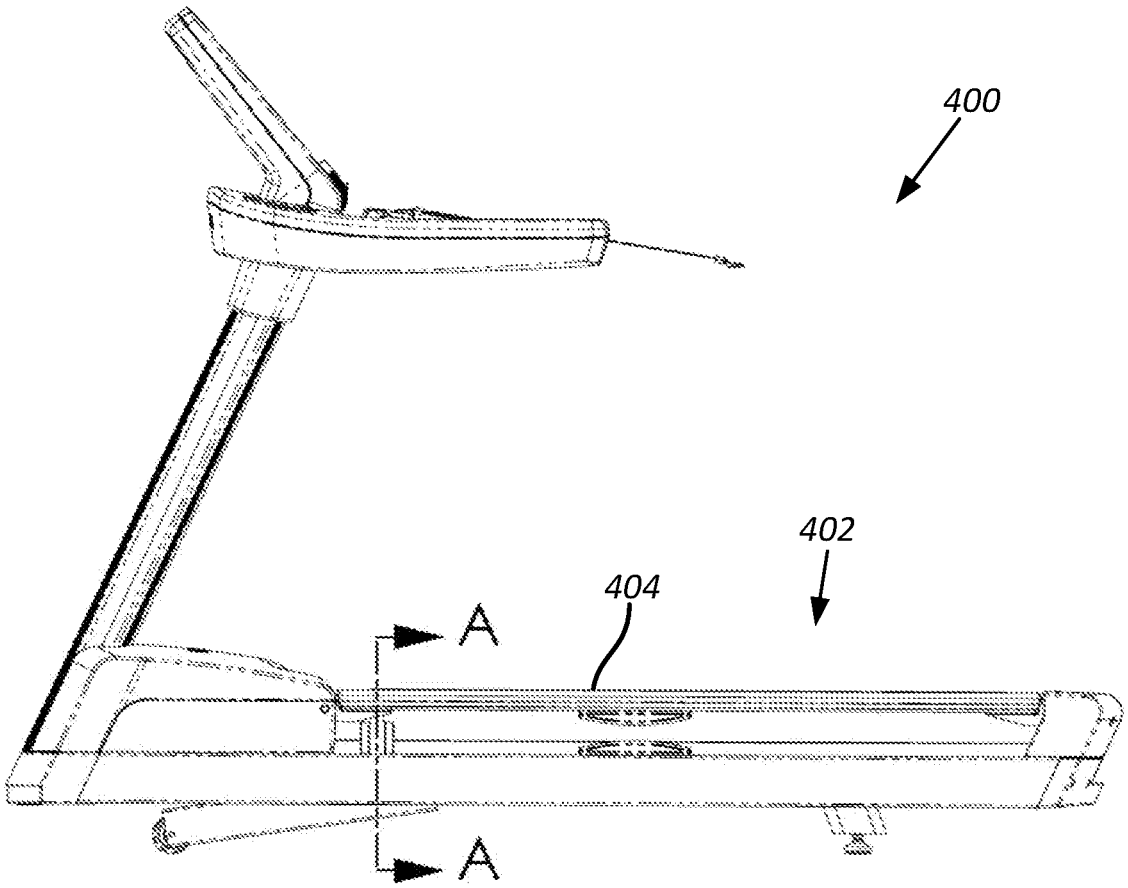
FIG. 4 illustrates a side view of an example of a treadmill in accordance with the present disclosure.
Figure 5A:
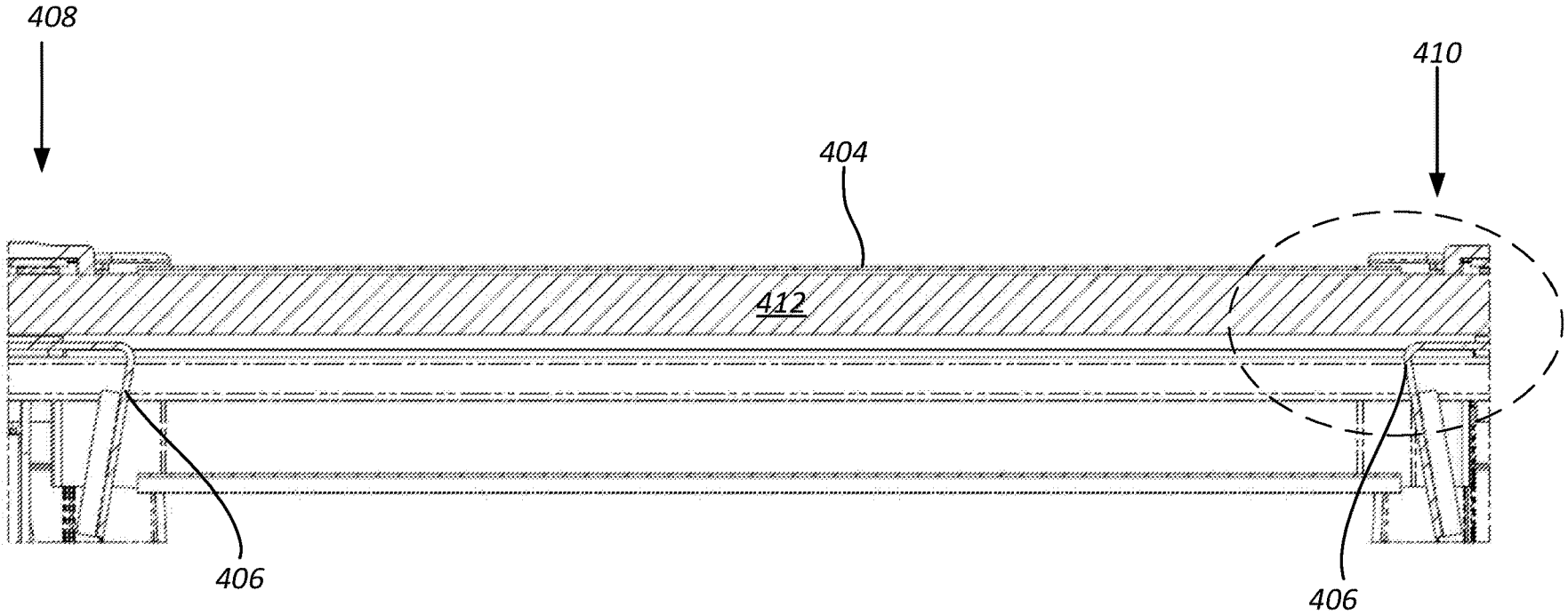
FIG. 5A illustrates a cross sectional view along line A-A of the example treadmill of FIG. 4 and in accordance with the present disclosure.
Figure 5B:
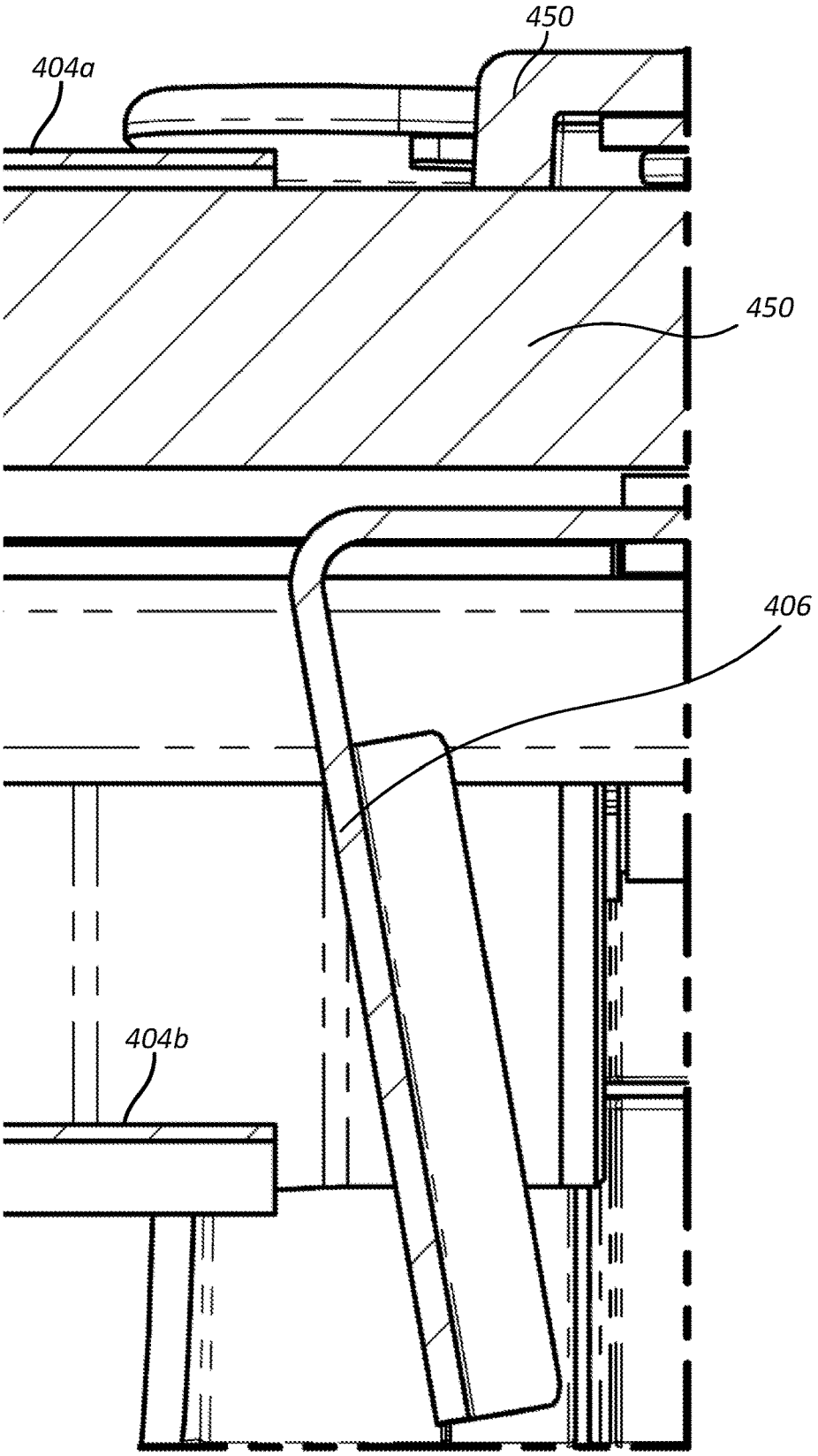
FIG. 5B illustrates a close up of the example depicted in FIG. 5B and in accordance with the present disclosure.

FIG. 4 depicts a side view of an example treadmill 400 as described herein with a deck 402 including a tread belt 404. FIG. 5A depicts a cross sectional view along line A-A of FIG. 4, showing the tread belt 404, as well as a belt guide 406 on both sides 408, 410 of the deck 402. In some cases, and as illustrated in FIG. 5A, the belt guide or guides 406 may be located to come into contact with the underside of the pulley. In some cases, the belt guide 406 may come into contact with underside of the deck's platform. FIG. 5B depicts a close up of the belt guide 406 depicted in FIG. 5A. In this example, the tread belt 404 is depicted with a top portion 404*a* over the sliding surface of the treadmill deck and a bottom portion 404*b* that is below the underside of the sliding surface 412. In this example, the belt guide 406 is located to make contact with the bottom portion 404*b* of the tread belt 404.

The belt guide 406 may be positioned away from the tread belt 404 when the tread belt is exactly centered on the sliding surface 412, but close enough so that when the tread belt 404 comes off of the riding portion 412, the edge of the tread belt 404 makes contact with the belt 406 and prevents the tread belt 404 from sliding off center even more. The belt guide 406 may be positioned to prevent the edge of the top portion 404*a* of the tread belt 404 from coming into contact with the deck rail 450. Preventing the tread belt 404 from contacting the deck rail 450 prevents damage to the deck rail 450 and to the tread belt 404.

In some cases, the belt guide 406 is spring loaded so that the belt guide 406 can exert a stronger realignment force on the tread belt 404 as counter forces increasingly push the tread belt off center. In some cases, the belt guide 406 is made of a sacrificial material that can be replaced if the belt guide 406 is worn down. In yet another example, the belt guide 406 may include a wear resistant material and/or wear resistant coating that can withstand a high amount of friction and/or heat.

Figure 6:
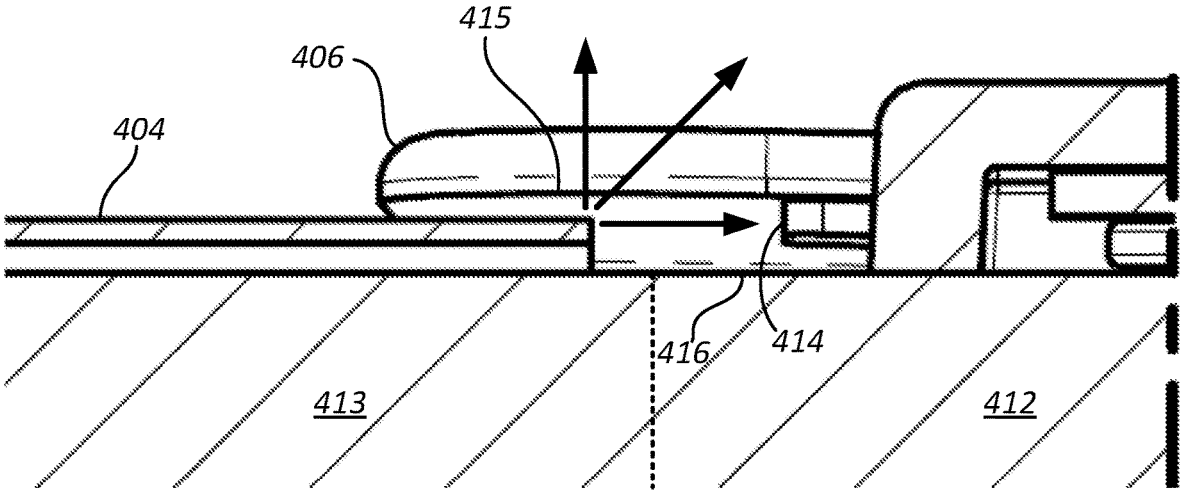
FIG. 6 illustrates an example of a belt guide incorporated into the top portion of the treadmill deck in accordance with the present disclosure.

FIG. 6 illustrates an alternative embodiment where the belt guide 406 is incorporated into the rear cover of the deck's platform. As described herein, a portion of the tread belt 404 is overlaid on the sliding surface of the platform and resides entirely within the central tread belt riding portion 413 of the sliding surface. In some cases, when the tread belt 404 stays entirely within the tread belt riding portion 413 while in motion the life of the tread belt 404 may be prolonged. In some cases, the tread belt riding portion 413 may be wider than the tread belt 404 to allow for some amount of lateral or vertical displacement of the tread belt 404 without causing undue wear.

However, in some situations the tread belt may become displaced and some portion of it may become positioned outside of the tread belt riding portion 413. The potential displacement directions of the tread belt 404 are indicated with arrows. For example, in some situations the tread belt may become laterally displaced, as indicated with the rightward facing arrow, such that an edge of the tread belt 404 extends outside of the tread belt riding portion. In other cases, the tread belt 404 may become off-canter, vertically displaced, or some combination of vertically and laterally displaced, as indicated with arrows. For example, due to a fold in the tread belt 404, lateral forces from a user, or any other mechanism of action may cause a distortion in the belt's alignment. Again, this displacement may lead the tread belt 404 to rub against or otherwise contact portions of the treadmill 400 outside of the tread belt riding portion 413 such that the tread belt will experience undesirable amounts of wear.

Figure 7:
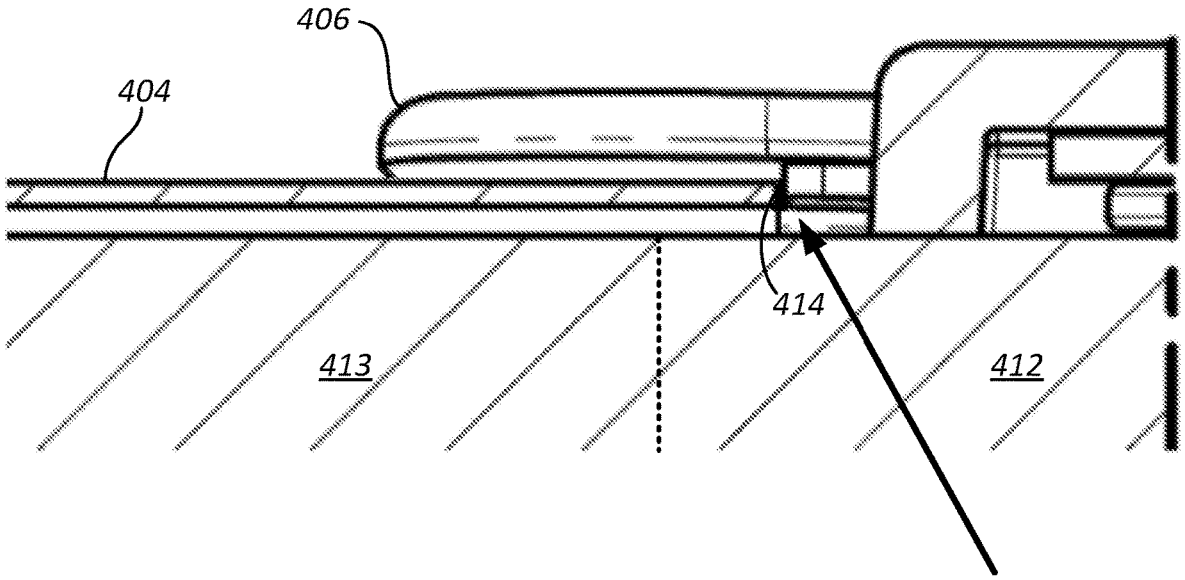
FIG. 7 illustrates an example of a belt guide incorporated into the top portion of the treadmill deck in accordance with the present disclosure.
Figure 8:
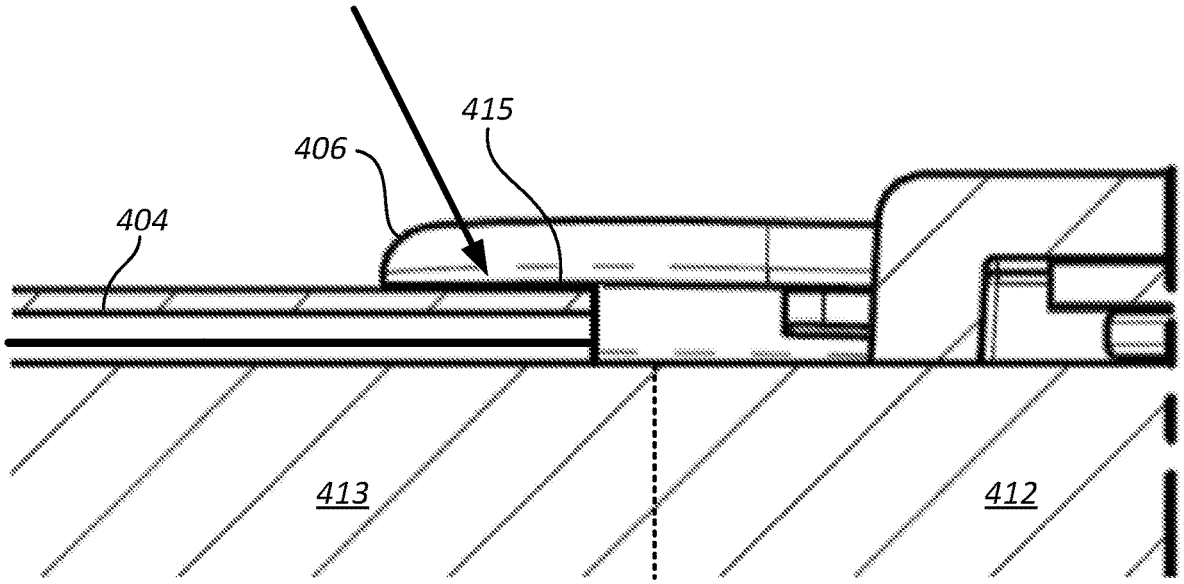
FIG. 8 illustrates an example of a belt guide incorporated into the top portion of the treadmill deck in accordance with the present disclosure.
Figure 9:
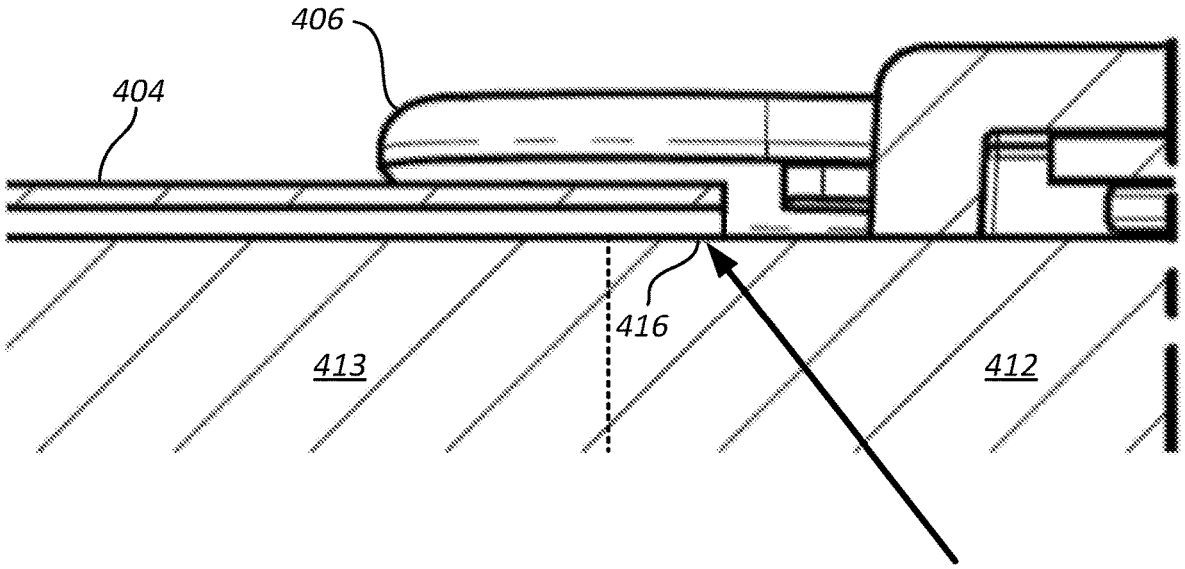
FIG. 9 illustrates an example of a belt guide incorporated into the top portion of the treadmill deck in accordance with the present disclosure.

FIGS. 7-9 depict various cases and embodiments where the tread belt 404 has become displaced such that a portion of the tread belt 404 is not within the tread belt riding portion 413. In FIGS. 7-9, the tread belt 404 is displaced such that a portion of the tread belt 404 contacts a textured portion of the belt guide 406 to thereby mechanically produce a sound audible to and distinguishable by a user when the tread belt 404 is in motion.

FIG. 7 depicts the treadmill 400 substantially similar to the treadmill depicted in FIGS. 4-6, including belt guide 406 with a textured portion at location 414. In contrast to FIG. 6, the tread belt 404 has become laterally displaced outside of the tread belt riding portion 413 of the sliding surface 412. As indicated by the arrow, an edge of the tread belt 404 may contact with the textured portion at location 414. When the tread belt 404 is in motion, the edge of the tread belt 404 rubs against the textured portion at location 414 to thereby mechanically produce a sound audible to and distinguishable by a user. While FIGS. 6 and 7 depict a belt guide 406 on one side of the treadmill 400, in some cases the opposing side of the treadmill 400 may also include a belt guide 406 having a textured portion at location 414. The inclusion of a second belt guide 406 may thus enable the treadmill to mechanically produce a noise when the tread belt 404 is laterally displaced in two directions.

FIG. 8 depicts the treadmill 400 substantially similar to the treadmill depicted in FIGS. 4-6, including belt guide 406 with a textured portion at location 415. In this embodiment, the textured portion is positioned such that vertical displacement of the tread belt 404 may cause a portion of the tread belt 404 to contact the textured portion at location 415, as indicated by the arrow. When the tread belt 404 is in motion the top surface of the tread belt 404 rubs against the textured portion at location 415 to thereby mechanically produce a sound audible to and distinguishable by a user. In some embodiments where the belt guide 406 includes a lip, as depicted in FIG. 8, the lip may be low enough such that the top surface of the tread belt 404 may contact the lip and textured portion at location 415 when the tread belt 404 is laterally displaced and is not vertically displaced.

FIG. 9 depicts the treadmill 400 substantially similar to the treadmill depicted in FIGS. 4-6, including belt guide 406 with a textured portion at location 416. In this embodiment, the textured portion may be located on a surface of the sliding surface 412 outside of the tread belt riding portion 413. In some other embodiments, a portion of the belt guide 406 may be disposed over the sliding surface 412 at least at location 416 and may include the textured portion. As indicated by the arrow, an interior surface of the tread belt 404 may contact with the textured portion at location 414. When the tread belt 404 is in motion, at least a portion of the interior surface of tread belt 404 rubs against the textured portion at location 416 to thereby mechanically produce a sound audible to and distinguishable by a user. While FIGS. 6 and 9 depict a belt guide 406 on one side of the treadmill 400, in some cases the opposing side of the treadmill 400 may also include a belt guide 406 having a textured portion at location 416. The inclusion of a second belt guide 406 may thus enable the treadmill to mechanically produce a noise when the tread belt 404 is laterally displaced in two directions.

Figure 10:
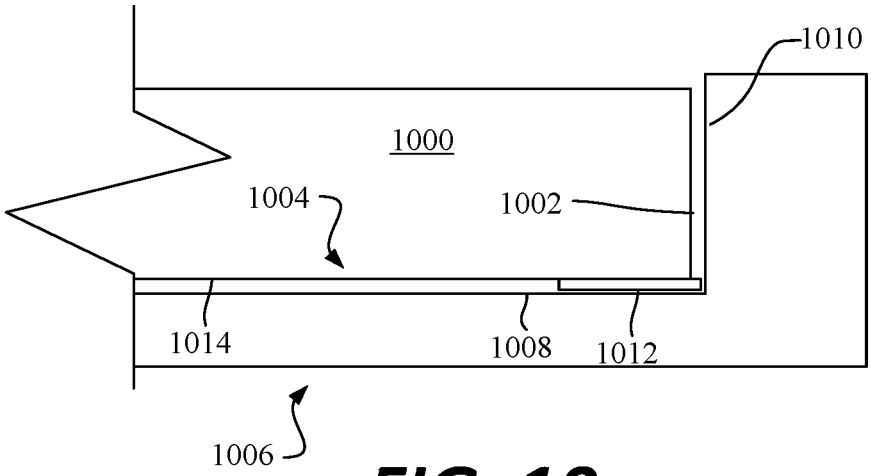
FIG. 10 illustrates an example of a location of a textured portion in accordance with the present disclosure.

FIG. 10 depicts an example of a tread belt 1000 with an edge 1002 that resides in a recessed region 1004 of the sliding surface 1006. The recessed region 1004 includes a bottom surface 1008 and a side wall 1010. In this example, a textured portion 1012 is located on the bottom surface 1008 adjacent to the side wall 1010. In this embodiment, when the tread belt 1000 misaligns by sliding towards the side wall 1010, the underside 1014 of the tread belt 1000 slides over the textured portion 1012. Collectively, the movement between the textured portion 1012 and the underside 1014 of the tread belt 1000 produce the misalignment sound.

Figure 11:
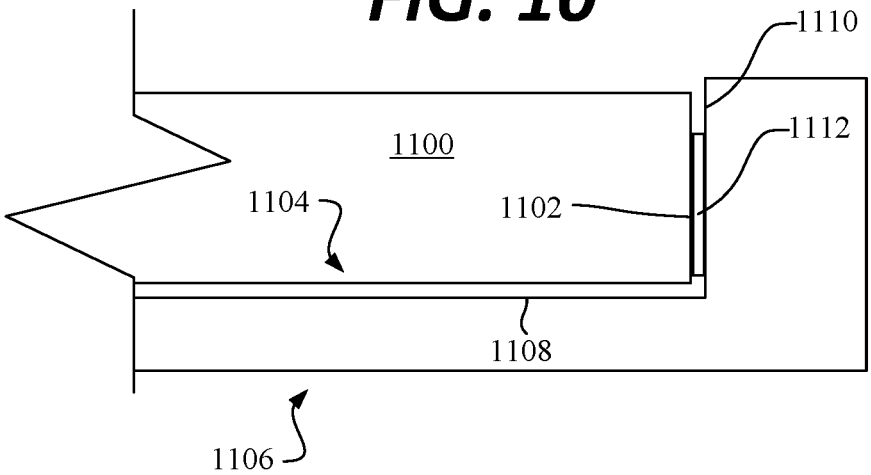
FIG. 11 illustrates an example of a location of a textured portion in accordance with the present disclosure.

FIG. 11 depicts an example of a tread belt 1100 with an edge 1102 that resides in a recessed region 1104 of the sliding surface 1106. The recessed region 1104 includes a bottom surface 1108 and a side wall 1110. In this example, a textured portion 1112 is located on the side wall 1110. In this embodiment, when the tread belt 1100 misaligns by sliding towards the side wall 1110, the edge 1102 of the tread belt 1100 slides into the textured portion 1112. Collectively, the movement between the textured portion 1112 and the edge 1102 of the tread belt 1100 produce the misalignment sound.

Figure 12:
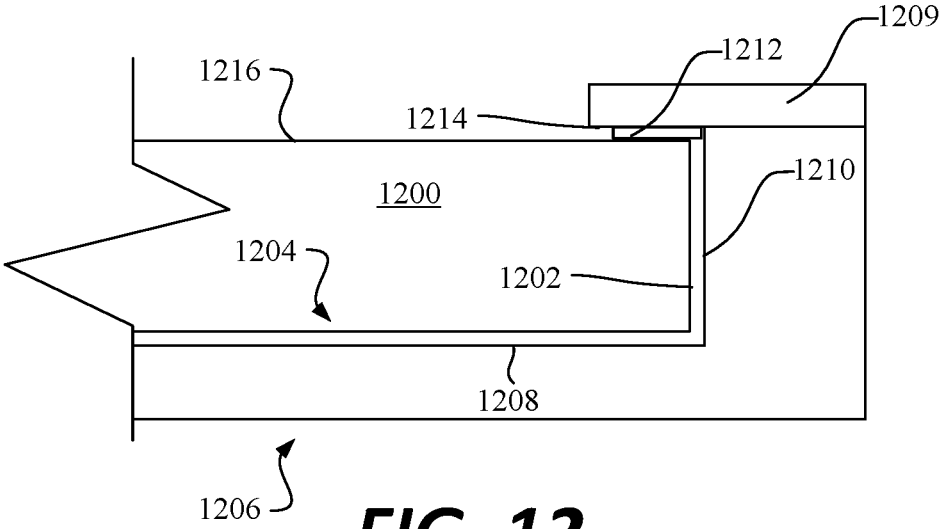
FIG. 12 illustrates an example of a location of a textured portion in accordance with the present disclosure.

FIG. 12 depicts an example of a tread belt 1200 with an edge 1202 that resides in a recessed region 1204 of the sliding surface 1206. The recessed region 1204 includes a bottom surface 1208 and a side wall 1210. A cover 1209 may be placed to cantilever over the side wall 1210 over the edge 1202 of the tread belt 1200. In this example, a textured portion 1212 is located on the underside 1214 of the cover 1209. In this embodiment, when the tread belt 1200 misaligns by sliding towards the side wall 1210, the top surface 1216 of the tread belt 1200 slides into contact with the textured portion 1212. Collectively, the movement between the textured portion 1212 and the edge 1202 of the tread belt 1200 produce the misalignment sound.

In relation to the examples above, the textured portion may be formed in the platform, sliding surface, cover, or other component of the platform. In other examples, the textured portion is adhered or otherwise attached to the components of the platform.

Figure 13:
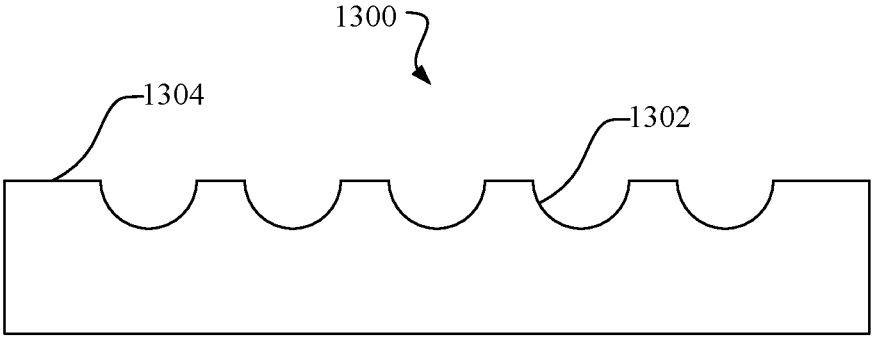
FIG. 13 illustrates an example of a textured portion in accordance with the present disclosure.

FIG. 13 depicts an example a textured portion 1300. In this example, a plurality of scoops 1302 are defined in the surface 1304 of a component of the platform outside of the tread belt riding portion.

Figure 14:
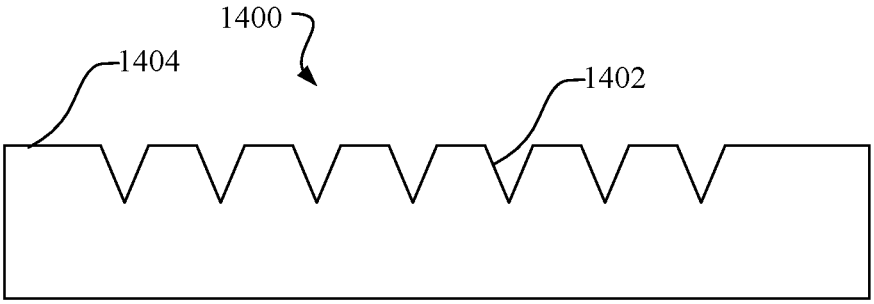
FIG. 14 illustrates an example of a textured portion in accordance with the present disclosure.

FIG. 14 depicts an example a textured portion 1400. In this example, a plurality of V-cuts 1402 are defined in the surface 1404 of a component of the platform outside of the tread belt riding portion.

Figure 15:
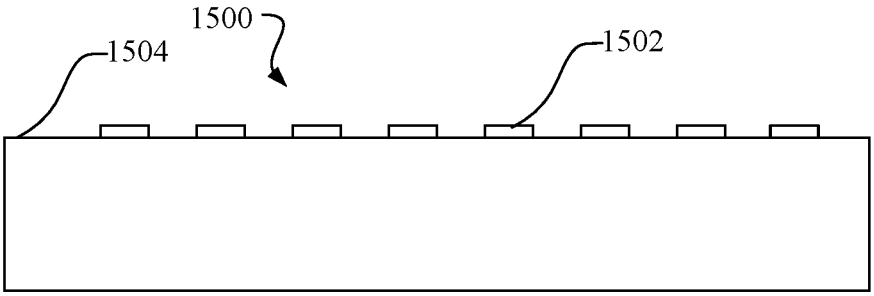
FIG. 15 illustrates an example of a textured portion in accordance with the present disclosure.

FIG. 15 depicts an example a textured portion 1500. In this example, a plurality of raised sections 1502 are formed on the surface 1504 of a component of the platform outside of the tread belt riding portion.

GENERAL DESCRIPTION

In general, the disclosure herein is directed to a treadmill that can alert a user when the tread belt is off-center, off-canter, or otherwise misaligned while in motion. A textured portion incorporated into the treadmill can mechanically produce a sound audible to a user when the tread belt is out of position in order to alert the user and allow the user to adjust the position of the tread belt.

The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route.

The platform may include a sliding surface that includes tread belt riding portion. The tread belt riding portion may be aligned with a central portion of either the front pulley and/or the rear pulley, where the tread belt is intended to surround the pulleys while the pulleys rotate and the tread belt moves. In some cases, when the tread belt is misaligned either of the front or rear pulley, the tread belt is misaligned out of the tread belt riding portion of the sliding surface of the platform. However, in some cases, the pulleys, may become misaligned causing the tread belt to be misaligned with the tread belt riding portion. When the tread belt is maintained in the tread belt riding portion, the tread belt is generally subjected to an intended amount of natural wear from the motion of the belt and pulleys such that the tread belt may only need replacement relatively infrequently. For example, when the tread belt is maintained in the tread belt riding portion, the tread belt may experience substantially minimal wear along its edges. However, in some cases, for example during routine use of the treadmill or due to lateral forces exerted on the tread belt by a user, the tread belt may become displaced such that a portion of the tread belt may be outside the tread belt riding portion while the tread belt is in motion. In these cases the tread belt may be subjected to undue wear, for example along the edges of the tread belt. If the tread belt is allowed to remain in a displaced position during use, for example in situations where the user does not realize the tread belt has been displaced, the tread belt may experience such significant wear that it may need to be replaced well before the intended lifetime of the belt has lapsed. Further, in cases where the tread belt remains in a displaced position during use of the treadmill, the tread belt may experience reduced stability as compared to when the entirety of the tread belt is within the tread riding portion.

In some cases, the treadmill includes a belt guide which may produce an audible sound when a portion of the tread belt is outside of its intended position while in motion against the sliding surface to notify or warn a user. For example, the belt guide and the tread belt may collectively produce a misalignment sound that is distinct and distinguishable by a user from the normal or routine operating sounds of the treadmill. In some embodiments the belt guide may mechanically produce an audible warning sound by contacting a portion of tread belt when it is displaced and in motion. In some cases, the belt guide may include a textured portion that contacts the tread belt when it has been displaced and is in motion. In some cases the mechanical action of the moving tread belt against the textured portion of the belt guide may produce the audible warning sound. As the treadmill including the audible belt guide produces an audible sound detectable by the user when the tread belt is displaced, the user may take appropriate action to realign or reposition the tread belt so that it is entirely within the tread belt riding portion. For example, the user may stop use of the treadmill and manually reposition the tread belt so that the tread belt is within the tread belt riding portion. As a consequence, the treadmill may not be used for a substantial duration with the tread belt out of position, and thus the tread belt may not experience undue wear that might have otherwise gone unnoticed. In this way, a treadmill including the belt guide as described herein may allow for reduced tread belt wear and longer tread belt life.

In one example, the treadmill may include a deck with a first pulley disposed in a first portion of the deck and a second pulley incorporated into a second portion of the deck. A tread belt surrounds the first pulley and the second pulley. A motor may be in mechanical communication with either the first pulley or the second pulley. A cover is superjacent the motor.

The treadmill may also include at least one belt guide that may audibly indicate to a user when the tread belt is off-center, off-canter, or otherwise displaced from a belt riding portion of the first and/or second pulley while in motion. For example, the belt guide may mechanically produce a sound that is audible to a user when the tread belt is off-center or otherwise out of position around the first and/or second pulleys.

In some cases, the treadmill may include an upright structure that supports a console. The console may include incorporates at least one input mechanism and a display. The input mechanism can control at least one parameter of the treadmill, such as the speed of the tread belt, the incline of the deck, a climate control, entertainment, and so forth.

The platform may include a belt guide that includes a textured portion which may be aligned with one or both of the tread belt's edges. The textured portion may mechanically produce a sound, such as a misalignment sound, when the tread belt's edges are sufficiently out of position so that an edge of the tread belt contacts the textured portion of the belt guide. For example the textured portion may be spaced apart from an edge of the tread belt such that one of the tread belt's edges contacts the textured portion when the tread belt is sufficiently out of position. In some cases, this contact may mechanically produce the misalignment sound when the tread belt is in motion, for example, by continuously rubbing against the textured portion of at least one of the belt guides. In some cases, the deck may include a belt guide on the left side and/or the right side of the deck.

In some cases the textured portion of the belt guide or guides may be positioned at any position along the length of the belt guide and may be aligned with an edge of the tread belt. In some cases the textured portion of the belt guide may run an entire length of the belt guide. However in some other cases, the textured portion may extend along between about half of the length of the belt guide and the entire length of the belt guide. In some cases the textured portion may extend along less than about half of the length of the belt guide, for example about ⅓, ¼, ⅛, 1/16, 1/32 or less of the length of the belt guide. In some embodiments the textured portion may not include one continuous portion and may be divided by one or more untextured portions of the belt guide. For example, the textured portion may include a first portion located near a first end of the belt guide and a second textured portion located near a second end of the belt guide.

The belt guide or guide may include a lip which extends over at least a portion of the tread belt and overlies the edge of the tread belt. In some cases, the textured portion of the belt guide may be positioned on an underside of the lip of the belt guide. However, in some other cases the textured portion may be located below the lip for example on the pulley or otherwise under the tread belt. In some cases, the textured portion may be position horizontally in line with an edge of the tread belt.

The tread belt may reside entirely within the central tread belt riding portion of the sliding portion. In some cases, when the tread belt stays entirely within the tread belt riding portion while in motion the life of the tread belt may be maximized. In some cases the tread belt riding portion may be wider than the tread belt to allow for some amount of lateral or vertical displacement of the tread belt without causing undue wear.

However, in some situations the tread belt may become displaced and some portion of it may become positioned outside of the tread belt riding portion. For example, in some situations the tread belt may become laterally displaced, such that an edge of the tread belt extends outside of the tread belt riding portion. In other cases the tread belt may become off-canter, vertically displaced, or some combination of vertically and laterally displaced, as indicated with arrows, for example due to a fold in the tread belt, lateral forces from a user, or any other mechanism of action. Again, this displacement may lead the tread belt to rub against or otherwise contact portions of the treadmill outside of the tread belt riding portion such that the tread belt experiences undesirable amounts of wear.

In some cases the textured portion may be located at position on the belt guide. That is, in some cases, the textured portion may be aligned with an edge of the tread belt and may be spaced apart therefrom when the tread belt is entirely within the tread belt riding portion. In some cases where the belt guide includes a lip which extends over at least a portion of the edge of the tread belt, the texture portion may be located at position. That is, in some cases, the textured portion may be positioned in line with and above an edge of the tread belt. In some cases the textured portion may be located on the surface outside of the tread belt riding portion.

In some cases the textured portion of the belt guide may mechanically produce a sound audible to the user when a least a portion of the tread belt is positioned outside of the tread belt riding portion and the tread belt is in motion. In some cases when the tread belt is sufficiently displaced outside of the tread belt riding portion while in motion, the tread belt may contact and rub against the textured portion of the belt guide. In some cases the texture may be selected to mechanically produce a sound audible to the user when the tread belt contacts and/or rubs against the textured portion while the tread belt is in motion. In some cases, the textured portion may include a textured surface. For example, the textured portion may include a plurality of protrusions, ribs, ridges, or otherwise raised portions. In some cases, the textured portion may include ribs that are arranged perpendicular to at least one edge of the tread belt.

In some cases, the textured portion may include a patterned surface, and the pattern may be selected to produce a desired noise that is audible to the user. For example, the textured portion may include a regular pattern or a repeating pattern selected to produce a distinctive noise, such as a high pitched noise. In some cases, the textured portion may include an irregularly patterned surface. In some cases, the textured portion may include a rough or non-smooth surface. In some cases where the textured portion includes a rough surface, the surface may have a roughness (calculated as the arithmetical mean deviation of the assessed profile, $R_a$) of more than about 1 micron, more than about 2 microns, more than about 5, 10, 25, 50, or 100 microns or more.

In some embodiments, the textured portion may be formed as part of the molding process of forming the belt guide. That is, a negative profile of the textured portion may be incorporated into the mold of the belt guide where the belt guide is formed by a molding process. In some cases, the textured portion may be formed by other manufacturing processes, such as subtractive processes, or any process known in the art or developed in the future.

In some embodiments, as the tread belt contacts or rubs against the textured portion, the rubbing between the tread belt and the textured portion may mechanically produce a misalignment sound. In some cases, the sound may be readily distinguishable by the user from the normal operating sounds of the treadmill, for example the sound may be distinguishable from the sounds produced by the motor, the pulleys, the tread belt riding on the pulleys, and any other routine operating sounds. In some cases, the sound is a misalignment sound, and may be readily perceived as such by the user. For example, in some cases the sound may be a high pitched warning sound. In some cases, the textured surface may be selected to produce a sound that is not pleasant to the user in order to deter the user from operating the treadmill while a portion of the tread belt may be positioned outside the tread belt riding portion. In some cases, the sound is not produced by electronic means. That is, in some cases, the sound is produced solely via the mechanical action between the textured portion and some portion of the tread belt contacting the textured portion while in motion.

The treadmill may make operational sounds during while the treadmill is in use that are distinguishable from the misalignment sounds. For example, the motion between the sliding surface and the underside of the tread belt may make an operational sound. But, the operational sound is distinguishable from the misalignment sound. For example, the misalignment sound may have the characteristic of having a different frequency, a different pitch, a different amplitude, another different characteristic, or combinations thereof.

In some embodiments, the textured portion is positioned such that vertical displacement of the tread belt may cause a portion of the tread belt to contact the textured portion. Such a displacement may be caused, for example, by a fold in the tread belt, or by the tread belt becoming off-canter. When the tread belt is in motion the top surface of the tread belt rubs against the textured portion to thereby mechanically produce a sound audible to and distinguishable by a user. In some embodiments where the belt guide includes a lip, the lip may be low enough such that the top surface of the tread belt may contact the lip and textured portion when the tread belt is laterally displaced and is not vertically displaced.

In some embodiments, an interior surface of the tread belt may contact with the textured portion. When the tread belt is in motion at least a portion of the interior surface of tread belt rubs against the textured portion to mechanically produce a sound audible to and distinguishable by a user. In some cases, the opposing side of the treadmill may also include a belt guide having a textured portion. The inclusion of a second belt guide may thus enable the treadmill to mechanically produce a noise when the tread belt is laterally displaced in two directions.

Several exemplary locations for the textured portion of the belt guide are described herein, however other locations of textured portion are expressly contemplated. In some cases any location that may contact the tread belt when at least a portion of the tread belt is outside of the tread belt riding portion, including being vertically displaced above the tread belt riding portion of the pulley may include a textured portion to thereby mechanically produce a sound audible to a user as described herein. Further, any combination of the locations of the textured portion is expressly contemplated, such that in some embodiments the treadmill may include a plurality of textured portions on a belt guide. In some examples, multiple textured portions may be included so that vertical, lateral, or any combination or vertical and lateral displacement of the tread belt outside of the tread belt riding portion may bring a portion of the tread belt into contact with a textured portion.

Further, although the belt guide is depicted as including a lip which overlies a portion of the edge of the tread belt, in some cases the belt guide may not include a lip. In some cases, the belt guide may include a vertical surface aligned with a spaced apart from the tread belt, such as ledge or rim. In other cases, the belt guide is flush with the sliding surface of the platform.

In some cases, the treadmill includes a console. The console may locate the input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the control console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

As the user begins to walk or run on the running deck, the display may change the scenery to mimic what the user would see if the user were actually at the real world location of the selected route. For example, a tree or another object located along the route that appears to be in the distance when the user is simulated to be at the beginning of the route may appear progressively closer as the user walks or runs on the running deck based on the speed at which the user is simulated to be traveling. Additionally, as the inclines and slopes of the simulated route change as the user progresses along the simulated route, the running deck can adjust to account for these terrain changes. For example, if the steepness of an uphill incline increases in the route, the running deck can likewise increase the incline of the running deck to mimic the change in steepness. Further, if the lateral angle of the route changes, the running deck can tilt laterally to one side to mimic the route's lateral angle.

While the programmed workout or the simulated environment may send control signals to orient the deck, the user may, in some instances, override these control signals with inputs from the console. For example, if the programmed workout or the simulated environment cause the deck to be steeper than the user desires, the user can adjust the deck's orientation through the console.

What is claimed is:

1. A treadmill, comprising:

an exercise deck, the exercise deck including:

a platform;

at least one pulley attached to the platform;

a sliding surface of the platform;

a tread belt riding portion defined in the sliding surface;

a tread belt surrounding the at least one pulley and the sliding surface, the tread belt having at least one edge; and a belt guide incorporated into the platform, the belt guide including:

a textured portion aligned with the at least one edge of the tread belt and spaced apart therefrom when the tread belt is positioned entirely within the tread belt riding portion;

wherein when the textured portion comes into contact with the tread belt due to the tread belt being misaligned with the tread belt riding portion, the tread belt and the textured portion interact to collectively produce a misalignment sound audible to a user.

2. The treadmill of claim 1, wherein the textured portion includes a plurality of ribs.

3. The treadmill of claim 2, wherein the plurality of ribs are arranged perpendicular to the at least one edge of the tread belt.

4. The treadmill of claim 1, wherein the belt guide includes a lip portion extending over at least a portion of the at least one edge of the tread belt.

5. The treadmill of claim 4, wherein the textured portion is positioned above the at least one edge of the tread belt.

6. The treadmill of claim 1, wherein the textured portion includes a plurality of protrusions.

7. The treadmill of claim 1, wherein the textured portion includes a rough surface having a Ra surface roughness of more than about 5 microns.

8. The treadmill of claim 1, wherein the textured portion includes a patterned surface.

9. The treadmill of claim 1, wherein the tread belt and the tread belt riding portion collectively produce an operating sound audible to the user when the tread belt is in motion with respect to the sliding surface when the tread belt is not in contact with the textured portion;

wherein the operating sound produces a different frequency than the misalignment sound.

10. The treadmill of claim 1, wherein the belt guide includes a raised ledge aligned with the at least one edge of the tread belt.

11. The treadmill of claim 1, wherein the textured portion contacts the at least one edge of the tread belt to mechanically produce the misalignment sound when the tread belt is in motion around the sliding surface and at least a portion of the tread belt is positioned outside the tread belt riding portion.

12. The treadmill of claim 1, wherein the textured portion contacts an interior pulley facing surface of the tread belt to mechanically produces the sound audible to the user when the tread belt is in motion around the at least one pulley and at least a portion of the tread belt is positioned outside the tread belt riding portion.

13. The treadmill of claim 1, wherein the misalignment sound is not produced when no portion of the tread belt is positioned outside the tread belt riding portion.

14. The treadmill of claim 1, wherein the misalignment sound is distinguishable by the user from routine operating sounds of the treadmill produced when the tread belt is entirely positioned within the tread belt riding portion.

15. A treadmill, comprising:

an exercise deck, the exercise deck including:

a platform;

at least one pulley attached to the platform;

a sliding surface of the platform;

a tread belt riding portion defined in the sliding surface;

a tread belt surrounding the at least one pulley, the tread belt having at least one edge; and a belt guide incorporated into the platform, the belt guide including:

a textured portion aligned with the at least one edge of the tread belt and spaced apart therefrom when the tread belt is positioned within the tread belt riding portion;

wherein the textured portion contacts the tread belt mechanically producing a misalignment sound audible when the tread belt is in motion with respect to the sliding surface and at least a portion of the tread belt is positioned outside the tread belt riding portion;

wherein the misalignment sound is not produced when the tread belt is positioned entirely within the tread belt riding portion and the misalignment sound is distinguishable from a routine operating sound of the treadmill.

16. The treadmill of claim 15, wherein the belt guide includes a lip portion extending over at least a portion of the at least one edge of the tread belt.

17. The treadmill of claim 16, wherein the textured portion is positioned above the at least one edge of the tread belt.

18. The treadmill of claim 15, wherein the belt guide includes a raised ledge aligned with the at least one edge of the tread belt.

19. The treadmill of claim 15, wherein the textured portion engages an underside surface of the tread belt when the tread belt is misaligned out of the tread belt riding portion.

20. A treadmill, comprising:

an exercise deck, the exercise deck including:

a platform;

a first pulley attached to the platform in a front portion;

a second pulley attached to the platform in a rear portion;

a sliding surface of the platform;

a tread belt riding portion of the sliding surface;

a tread belt surrounding the first pulley, the second pulley, and the sliding surface, the tread belt having at least one edge and a top surface; and a belt guide incorporated into the platform, the belt guide including:

a lip portion extending over at least a portion of the at least one edge of the tread belt;

a textured portion including a rough surface, the textured portion aligned with and positioned above the at least one edge of the tread belt and spaced apart therefrom when the tread belt is positioned within the tread belt riding portion;

wherein the textured portion contacts the top surface of the tread belt to thereby mechanically produce a misalignment sound audible to a user when the tread belt is in motion with respect to the sliding surface of the platform and at least a portion of the tread belt is positioned outside the tread belt riding portion;

wherein the misalignment sound is not produced when the tread belt is positioned entirely within the tread belt riding portion and the misalignment sound is distinguishable by the user from a routine operating sound of the treadmill.

* * * * *